US008360816B2

(12) United States Patent
Michel

(10) Patent No.: US 8,360,816 B2
(45) Date of Patent: Jan. 29, 2013

(54) ARTICLE OF CLOTHING WITH WICKING PORTION

(75) Inventor: Joyce Michel, New York, NY (US)

(73) Assignee: Michel Licensing, Inc., New York, NY (US)

( * ) Notice: Subject to any disclaimer, the term of this patent is extended or adjusted under 35 U.S.C. 154(b) by 0 days.

(21) Appl. No.: 12/795,226

(22) Filed: Jun. 7, 2010

(65) Prior Publication Data

US 2010/0240280 A1 Sep. 23, 2010

Related U.S. Application Data

(62) Division of application No. 10/515,580, filed as application No. PCT/US03/16885 on May 27, 2003, now Pat. No. 7,752,681.

(60) Provisional application No. 60/382,964, filed on May 24, 2002.

(51) Int. Cl.
*A41C 3/00* (2006.01)

(52) U.S. Cl. ..... 450/93

(58) Field of Classification Search ..... 2/400; 450/40, 450/65, 66, 92, 93; 66/169 R, 170, 171, 66/172 E, 176, 196
See application file for complete search history.

(56) References Cited

U.S. PATENT DOCUMENTS 3,132,497 A * 5/1964 Garrou ..... 66/202
3,500,665 A * 3/1970 Schoffner et al. ..... 66/176
3,508,279 A 4/1970 Ayoub
3,537,279 A * 11/1970 Epley ..... 66/176
3,694,816 A 10/1972 Smith
3,696,444 A 10/1972 Berry
3,701,164 A 10/1972 Blore
3,757,354 A 9/1973 Moody
3,772,899 A * 11/1973 Novi ..... 66/176
3,801,987 A 4/1974 Thompson, Jr.
3,842,519 A 10/1974 Lapidus
3,844,826 A 10/1974 Buchner et al.
3,922,723 A 12/1975 Popper
3,959,556 A 5/1976 Morrison
3,971,234 A * 7/1976 Taylor ..... 66/200
4,047,400 A * 9/1977 Thorneburg ..... 66/171
4,126,903 A 11/1978 Horton
4,155,123 A 5/1979 Popper
4,206,514 A 6/1980 Yamauchi
4,228,549 A 10/1980 Rispoli (Continued)

FOREIGN PATENT DOCUMENTS

EP 0746646 A1 12/1996

(Continued)

OTHER PUBLICATIONS

No Author, Bioactive Fibre has Permanent Antimicrobial Properties, Advances in Textiles Technology; Aug. 2001.

(Continued)

*Primary Examiner* — Alissa L Hoey
(74) *Attorney, Agent, or Firm* — Fitzpatrick, Cella, Harper & Scinto

(57) ABSTRACT

Articles of clothing that incorporate fabrics or chemicals having wicking, antibacterial/antifungal and low coefficients of friction either overall or in specific areas of the apparel that will minimize the development of irritation, bacterial and fungal infections of the skin. The invention also includes methods for producing this wicking, antibacterial/antifungal and low coefficient of friction apparel.

22 Claims, 19 Drawing Sheets

U.S. PATENT DOCUMENTS

| | | | | | |
|---|---|---|---|---|---|
| 4,241,462 | A | | 12/1980 | Tagawa et al. | |
| 4,244,059 | A | | 1/1981 | Pflaumer | |
| 4,244,367 | A | | 1/1981 | Rollenhagen | |
| 4,261,061 | A | | 4/1981 | McAlvage | |
| 4,285,343 | A | | 8/1981 | McNair | |
| 4,333,183 | A | | 6/1982 | Popper | |
| 4,343,853 | A | | 8/1982 | Morrison | |
| 4,393,521 | A | | 7/1983 | Jones | |
| 4,531,525 | A | * | 7/1985 | Richards | 450/65 |
| 4,758,241 | A | | 7/1988 | Papajohn | |
| 4,784,909 | A | | 11/1988 | Emi et al. | |
| 4,805,240 | A | | 2/1989 | Siqveland | |
| 4,843,844 | A | | 7/1989 | Hursh et al. | |
| 4,846,829 | A | | 7/1989 | Lloyd | |
| 4,875,241 | A | * | 10/1989 | Browder et al. | 2/409 |
| 4,881,276 | A | | 11/1989 | Swan | |
| 4,881,383 | A | * | 11/1989 | Spillane et al. | 66/194 |
| 4,898,007 | A | | 2/1990 | Dahlgren | |
| 4,922,551 | A | | 5/1990 | Anthes | |
| 4,999,854 | A | | 3/1991 | Fell | |
| 5,019,070 | A | | 5/1991 | Ruben | |
| 5,037,418 | A | | 8/1991 | Kons et al. | |
| 5,065,600 | A | * | 11/1991 | Byles | 66/193 |
| 5,075,901 | A | | 12/1991 | Vollrath | |
| 5,269,720 | A | | 12/1993 | Moretz et al. | |
| 5,271,211 | A | | 12/1993 | Newman | |
| 5,308,121 | A | | 5/1994 | Gunn | |
| 5,312,667 | A | * | 5/1994 | Lumb et al. | 428/91 |
| 5,385,502 | A | | 1/1995 | Moretz et al. | |
| 5,390,376 | A | | 2/1995 | Marx et al. | |
| 5,392,467 | A | | 2/1995 | Moretz et al. | |
| 5,453,268 | A | | 9/1995 | Ueno et al. | |
| 5,503,434 | A | | 4/1996 | Gunn | |
| 5,533,212 | A | | 7/1996 | Moretz et al. | |
| 5,542,269 | A | * | 8/1996 | Richards | 66/195 |
| 5,553,468 | A | * | 9/1996 | Osborne | 66/171 |
| 5,557,950 | A | * | 9/1996 | Richards et al. | 66/194 |
| 5,590,420 | A | | 1/1997 | Gunn | |
| 5,636,377 | A | | 6/1997 | Wiener | |
| 5,651,847 | A | * | 7/1997 | Loeffler | 66/19 |
| 5,669,247 | A | * | 9/1997 | McCartney et al. | 66/195 |
| 5,698,303 | A | | 12/1997 | Caldwell | |
| 5,722,127 | A | | 3/1998 | Coates | |
| 5,724,673 | A | | 3/1998 | Aldridge | |
| 5,737,776 | A | | 4/1998 | Jennings | |
| 5,752,278 | A | | 5/1998 | Gunn | |
| 5,768,713 | A | | 6/1998 | Crick | |
| 5,778,702 | A | | 7/1998 | Wrightenberry | |
| 5,792,714 | A | | 8/1998 | Schindler et al. | |
| 5,797,364 | A | | 8/1998 | Meek et al. | |
| 5,809,577 | A | | 9/1998 | Getz | |
| 5,814,037 | A | | 9/1998 | Coates | |
| 5,819,316 | A | | 10/1998 | Aldridge | |
| 5,827,261 | A | | 10/1998 | Osborn, III et al. | |
| 5,829,057 | A | | 11/1998 | Gunn | |
| 5,850,745 | A | * | 12/1998 | Albright | 66/176 |
| 5,855,124 | A | * | 1/1999 | Donaghy et al. | 66/195 |
| 5,858,888 | A | | 1/1999 | Underwood et al. | |
| 5,864,891 | A | | 2/1999 | Gonzales | |
| 5,868,727 | A | | 2/1999 | Barr et al. | |
| 5,878,442 | A | | 3/1999 | Pejak | |
| 5,891,122 | A | | 4/1999 | Coates | |
| 5,915,531 | A | | 6/1999 | Hilpert et al. | |
| 5,921,976 | A | | 7/1999 | Seymore | |
| 6,000,057 | A | | 12/1999 | Newman | |
| 6,041,446 | A | | 3/2000 | Braunstein et al. | |
| 6,061,829 | A | | 5/2000 | Gunn | |
| 6,071,602 | A | | 6/2000 | Caldwell | |
| 6,079,050 | A | | 6/2000 | Hooper-Jackson | |
| 6,079,235 | A | * | 6/2000 | Schmidt | 66/136 |
| 6,082,146 | A | | 7/2000 | Dahlgren | |
| 6,108,820 | A | | 8/2000 | Bernhardt | |
| 6,116,059 | A | * | 9/2000 | Rock et al. | 66/191 |
| 6,124,221 | A | | 9/2000 | Gabbay | |
| 6,138,276 | A | | 10/2000 | Asciutto et al. | |
| 6,143,368 | A | | 11/2000 | Gunn | |
| 6,145,129 | A | | 11/2000 | Czekalla et al. | |
| 6,178,784 | B1 | * | 1/2001 | Marley, Jr. | 66/173 |
| 6,196,032 | B1 | * | 3/2001 | Rock et al. | 66/195 |
| 6,199,410 | B1 | * | 3/2001 | Rock et al. | 66/195 |
| 6,247,179 | B1 | | 6/2001 | Underwood et al. | |
| 6,254,583 | B1 | | 7/2001 | Coates | |
| 6,264,967 | B1 | | 7/2001 | Ito et al. | |
| 6,276,175 | B1 | | 8/2001 | Browder, Jr. et al. | |
| 6,287,689 | B1 | | 9/2001 | Elliott et al. | |
| 6,341,505 | B1 | | 1/2002 | Dahlgren | |
| 6,351,852 | B1 | | 3/2002 | Propp | |
| 6,378,138 | B1 | | 4/2002 | Ridgley et al. | |
| 6,499,320 | B1 | | 12/2002 | Bernhardt | |
| 6,596,207 | B1 | | 7/2003 | Gunn | |
| 6,630,087 | B1 | | 10/2003 | Hancock et al. | |
| 6,766,539 | B1 | | 7/2004 | Huber | |
| 6,779,367 | B2 | | 8/2004 | Mitchell et al. | |
| RE38,624 | E | | 10/2004 | Hofgen et al. | |
| 6,823,530 | B2 | | 11/2004 | Quincy, III | |
| 6,836,901 | B2 | | 1/2005 | Hippensteel | |
| 6,863,589 | B2 | * | 3/2005 | Cano | 450/65 |
| 6,986,270 | B2 | | 1/2006 | Miller, III et al. | |
| 7,012,525 | B1 | | 3/2006 | Ghioto | |
| 7,024,892 | B2 | | 4/2006 | Blakely | |
| 7,213,420 | B2 | | 5/2007 | Lynch et al. | |
| 7,614,256 | B2 | * | 11/2009 | Mitchell | 66/179 |
| 7,927,179 | B2 | * | 4/2011 | Kaye | 450/86 |
| 2002/0022433 | A1 | | 2/2002 | Yeung et al. | |
| 2002/0022813 | A1 | | 2/2002 | Bewick-Sonntag et al. | |
| 2002/0148258 | A1 | * | 10/2002 | Cole et al. | 66/202 |
| 2003/0039834 | A1 | | 2/2003 | Gunn | |
| 2003/0131394 | A1 | | 7/2003 | Chou et al. | |
| 2003/0167550 | A1 | | 9/2003 | Andrews | |
| 2003/0168118 | A1 | | 9/2003 | Metzger | |
| 2003/0171066 | A1 | * | 9/2003 | Mitchell et al. | 450/66 |
| 2003/0182922 | A1 | | 10/2003 | Peters et al. | |
| 2004/0198178 | A1 | * | 10/2004 | Mitchell et al. | 450/66 |
| 2004/0237599 | A1 | * | 12/2004 | Kondou et al. | 66/202 |
| 2005/0277352 | A1 | * | 12/2005 | Bonnin et al. | 442/304 |

FOREIGN PATENT DOCUMENTS

| | | | |
|---|---|---|---|
| EP | 0819389 | A2 | 1/1998 |
| EP | 0826083 | A2 | 3/1998 |
| WO | 9106593 | A1 | 5/1991 |
| WO | 9525444 | A1 | 9/1995 |
| WO | 9700347 | A2 | 1/1997 |
| WO | 9721411 | A1 | 6/1997 |
| WO | 9727861 | A1 | 8/1997 |
| WO | 9731604 | A1 | 9/1997 |
| WO | 9807908 | A2 | 2/1998 |
| WO | 9833465 | A1 | 8/1998 |
| WO | 9844817 | A1 | 10/1998 |
| WO | 9923903 | A1 | 5/1999 |
| WO | 9940246 | A1 | 8/1999 |
| WO | 9944548 | A1 | 9/1999 |
| WO | 0144306 | A2 | 6/2001 |
| WO | 0162196 | A1 | 8/2001 |

OTHER PUBLICATIONS

No Author, New Nylon Yarn is Bacteriostatic, Chemical and Engineering News; Jul. 17, 2000; p. 17.

O. Sattaur, Clothes for the Fashionably Fit, New Scientist Dec. 22/29, 1990; pp. 38-40.

No Author, Antibacterial Nylon Fibre, High Perform. Textiles; 1989 Elsevier Science Publishers, Ltd: Aug. 1989; p. 4.

M.D. Teli, S.M. Dandage, N. Chattopadhyay, New Developments in High-Performance Fibres: An Overview, Journal of the Textile Assoc.; Jul.-Aug. 2000: pp. 53-57.

D. Buirski, Just slip into Something a Little More Comfortable, World Sports Activewear: pp. 49-50.

N. Butler, Citius, Altius, Fortius—Faster, Higher Stronger, Technical Textiles International; Oct. 2000; pp. 24-27.

R. Stevanato, R. Tedesco, New antibacterial acrylic fiber, Chemical Fibers International; vol. 48 (Dec. 1998): pp. 480-485.

* cited by examiner

FIG. 13
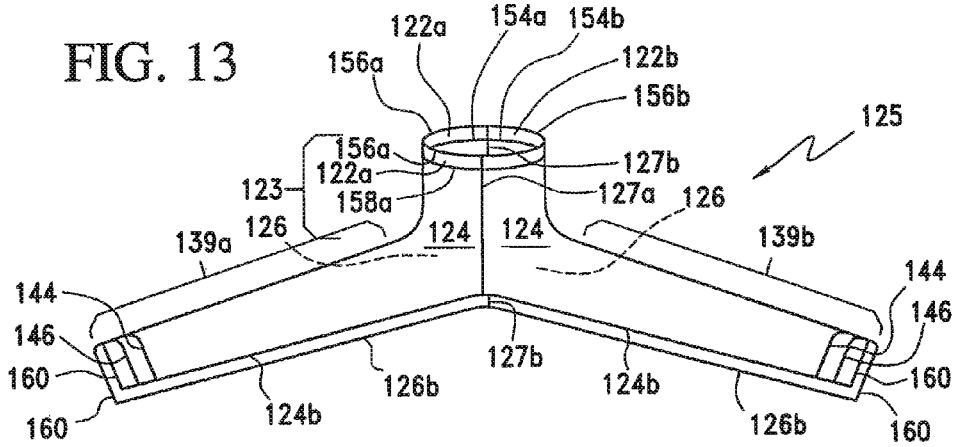
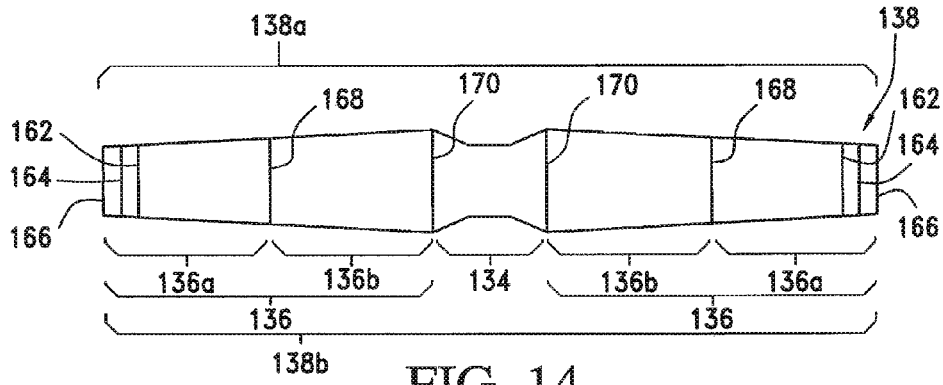
FIG. 14
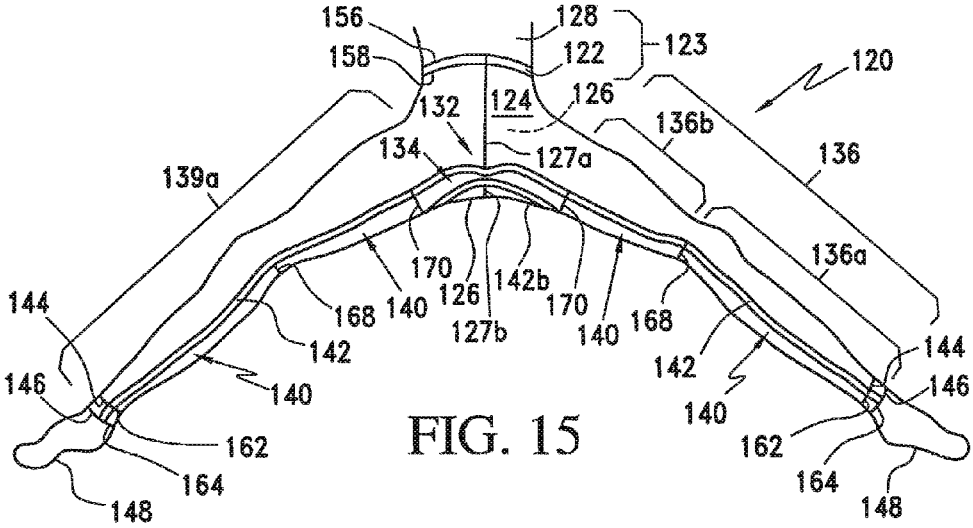
FIG. 15

FIG. 21
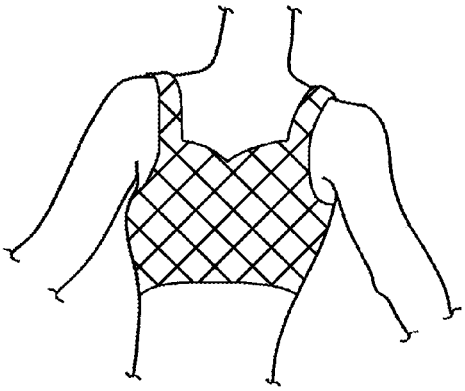
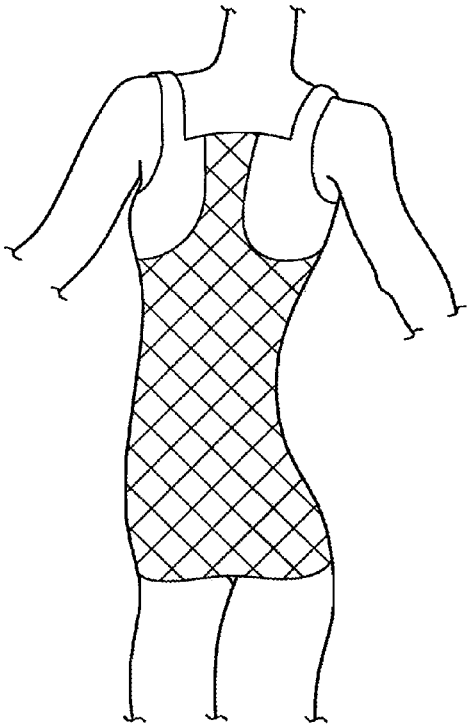
FIG. 22

ARTICLE OF CLOTHING WITH WICKING PORTION

CROSS-REFERENCE TO RELATED APPLICATIONS

This is a division of application Ser. No. 10/515,580, filed on Nov. 23, 2004, which is the national phase of International Application No. PCT/US2003/016885, filed on May 27, 2003, claiming the benefit of Provisional Application No. 60/382,964, filed on May 24, 2002. The entire contents of these earlier applications are incorporated by reference.

FIELD OF THE INVENTION

This invention relates to wicking, antibacterial/bacteriostatic/antifungal, (hereinafter referred to as antibacterial/antifungal, antibacterial/bacteriostatic, or antibacterial/bacteriostatic/antifungal), and low friction apparel and methods for producing same, such as clothing, fabrics and the like. More particularly, the invention relates to wicking, antibacterial/antifungal, low friction apparel which incorporates fabrics or chemicals which wick, have antibacterial/antifungal properties and low coefficient of friction either overall or in specific areas of the apparel that will minimize the development of irritation of a person's skin and related bacterial and fungal infections. The invention also includes methods for producing the wicking, antibacterial/antifungal and low friction apparel and methods for using wicking, antibacterial/antifungal and low friction materials to reduce moisture, friction and the resulting bacterial and fungal infections due to skin moisture and irritation. More particularly, the invention relates to apparel, which incorporates fabrics or chemicals having antibacterial/antimicrobial, wicking, and low friction coefficient of friction properties either overall, or in specific areas of the apparel that will minimize the development of irritation of an apparel wearer's body surface. The invention also includes methods for producing the antibacterial/antifungal, wicking and low friction apparel and methods for using antibacterial/antifungal, wicking and low coefficient of friction materials to reduce irritation and infections.

The invention relates to apparel with an interior wicking surface against the skin that also has antibacterial/antifungal properties with an exterior low friction surface and methods for producing same. More particularly, the invention relates to apparel with a wicking surface against the skin which incorporates fibers or chemicals that have antibacterial/antifungal properties and a low friction outer surface which incorporates fibers or chemicals having a low coefficient of friction either overall or in specific areas of the apparel, such that the wicking, antibacterial/antifungal surface will be on the interior of the apparel and the low friction surface will be presented on the exterior of the apparel.

BACKGROUND OF THE INVENTION

Skin when rubbing against another surface of skin causes irritation, breaks down and becomes irritated. Perspiration is usually also present in areas where skin rubs together. Intertrigo, or a rash in body folds, develops. Affected skin is reddened and uncomfortable. Body folds are prone to inflammatory rashes because the skin has a relatively high temperature, moisture from insensible water loss and sweat cannot evaporate, and friction from movement of adjacent skin results in chafing. Bacteria, fungus and yeasts, which are normally resident on the skin, multiply in such environments and may result in further damage to the skin.

It can appear anywhere two skin surfaces lie next to each other and rub together, but most often occur in the skin folds of the groin, the inner thigh area, underarms, between the ribs, and under and between the breasts. This condition is most common in warm climates and during the summer months. Intertrigo will appear as a reddish color rash that might be sore or itchy. It normally progresses gradually, starting as a mild chafing, then slowly, with continued exposure to moisture and friction, develops into a persistent itchy rash. Sometimes a secondary bacterial or fungal infection may occur, causing the formation of pustules and weeping and oozing of the skin, as well as severe itching and pain. Severe Intertrigo on the groin or thighs can limit or affect mobility. Intertrigo primarily affects overweight people who perspire heavily and people with diabetes. It can also occur in any individual where fat distribution causes two surfaces of the skin to rub together. Persons who suffer from urinary incontinence are at increased risk of developing Intertrigo in the groin area. Once a person develops Intertrigo it is usually chronic and reoccurring.

Previous patents have addressed part of the problem, that is, the addition of fibers with low co-efficient of friction into apparel to reduce friction. Or, conversely, patents exist which only address wicking properties, especially garments designed for incontinence problems. In doing so, they only addressed part of the problem with skin irritation. None have addressed both factors, that is, moisture and friction as being the causative agents for creating Intertrigo. Prior art has failed to combine wicking and low friction materials to solve the problem and with obesity becoming an epidemic world wide a solution to this problem is important.

Robert T. Gunn's U.S. Pat. No. 5,752,278, May 19, 1998, U.S. Pat. No. 5,829,057, Nov. 3, 1998, and U.S. Pat. No. 5,752,278, May 19, 1998 acknowledge that irritation is caused by moisture and friction. He states, "the addition of low friction material to the fiber, yarn, fabric or article can also be useful to wick away moisture from the skin to help guard against irritation as well as wetness." However, according to the DuPont Technical Information brochure, TEFLON® PTFE, Properties, Processing, and Applications, which he makes reference to, the moisture regain percentage for TEFLON® is 0.0%. All of the garments heretofore known suffer from a number of disadvantages:

Since irritation of the skin is known to result from moisture and friction, the addition of a fiber with 0.0% moisture absorption properties while serving to facilitate wicking would not work as efficiently as a fiber whose sole function is to wick and absorb perspiration.

Gunn's patent's primarily teach the addition of low friction materials which are incorporated into both sides of the material. When he teaches plating as a method, he only includes weaving, not knitting, as the preferred method.

Gunn's patents include apparel with seams in the inner thigh area. The addition of seams in the inner thigh area causes irritation of the skin. His patent does not address the addition of an inner thigh panel or circular knitting techniques, which eliminate seams altogether, as a preferred method of constructing a garment. His solution is the addition of low friction fibers to the seams instead of the elimination of seams altogether in this area.

Gunn's patents do not add any fiber or chemical which are antibacterial/antifungal into the garment to help with infections that are secondary to skin irritation once moisture and friction are present.

Gunn's patents teach the use of low friction materials on the exterior of both sides of the inner surfaces of the thigh areas. This method can be used, however, exterior plating on one surface of the inner thigh area is sufficient to reduce friction on both surfaces and he does not teach this.

OBJECTS AND ADVANTAGES

Apparel is made out of many materials, natural and man-made as well as blends. They can be natural such as cotton, silk, linen, or leather. They can also be man made such as nylon, vinyl, spandex, polyester, TEFLON®, rayon, or any combination of natural or manmade fibers.

Accordingly, several objects and advantages of my invention are:

the addition of a layer of wicking fibers or chemicals to the interior surface of the apparel to absorb all perspiration to keep the skin dry.

the addition of antibacterial/antifungal fibers or chemicals into the moisture absorption layer of the apparel to protect the skin from infections.

the method of plating wicking fibers on the interior surface, with antibacterial/antifungal properties, and low friction fibers on the exterior surface instead of the fibers all being woven together.

the method of knitting instead of weaving as the preferred method of plating the fibers since knitted garments contour to the body more easily and cause less friction because they conform more.

the method of constructing the garments on a circular knitting machine as a way of avoiding seams, especially in the inner thigh or underarm areas, as the preferred method of constructing the garments. Or, the method of sewing a plated panel or gusset with wicking, antibacterial/antifungal and low friction properties into the garment, for example, in the inner thigh or underarm areas, which eliminate seams in these areas.

the addition of antibacterial/antifungal fibers or chemicals into the garment to help with infections that are secondary to skin irritation once moisture and friction are present.

the use of low friction materials on only one, versus both, exterior surface of the inner thigh areas or underarm areas, to reduce friction between the legs, or under the arms, as a means of cutting down heat and friction between the legs, or under the arms. TEFLON® and other low friction fibers, such as nylon, are high heat retention fibers. Thus, to only plate one side of an area in apparel where two sides oppose each other, for example, one side of the inner thigh area, for example, the right side, where the left side is not plated, or one side of the underarm area, for example the top or bottom portion of the gusset with the opposite area not being plated, would be an added advantage in terms of heat reduction.

the use of low friction materials, which are costly, on one side only of an inner thigh or underarm area, would significantly reduce costs for manufacturers and consumers.

It would be highly desirable to have apparel which has a wicking, anti-bacterial/antifungal inner layer plated with an exterior low friction material in areas of high body surface contact such that irritations and the secondary skin infections are avoided.

SUMMARY OF THE INVENTION

It is the principle object of the invention to is provide wicking, antibacterial/-bacteriostatic/antifungal, low friction apparel which avoids or minimizes the development of skin irritations due to moisture and friction which can lead to the development of skin infections.

From the description above, my knit sewn in leg panel, a cut and sew leg panel, gussets, or a plated area in a circular knit method has the additional advantages in that:

a further object of the invention is to provide a method for producing the wicking, antibacterial/bacteriostatic/antifungal, low friction apparel by chemically treating the wicking yarns or fibers or the like of the material from which the apparel is made prior to or after production with antibacterial/-bacteriostatic/antifungal chemicals.

a further object of the invention is to provide a method for producing wicking, antibacterial/bacteriostatic/antifungal, low friction apparel by incorporating wicking, antibacterial/bacteriostatic/antifungal, low friction yarns and fibers into the fabric from which the apparel is made.

a further object of the invention is to provide a method for producing a wicking, antibacterial/bacteriostatic/antifungal, low friction inner leg panel by incorporating wicking and low friction, antibacterial/bacteriostatic/antifungal, yarns and fibers into the fabric from which the apparel is made.

a further object of the invention is to provide a method for producing a wicking, antibacterial/bacteriostatic/antifungal, low friction underarm gusset by incorporating wicking and low friction yarns and fibers into the fabric and chemically treating them with antibacterial/bacteriostatic/antifungal chemicals which the apparel includes.

a further object of the invention is to provide a method for producing a wicking, antibacterial/bacteriostatic/antifungal inner leg panel by incorporating wicking, antibacterial/bacteriostatic/antifungal, yarns and fibers into the fabric from which the apparel is made.

a further object of the invention is to provide a method for producing a wicking, antibacterial/bacteriostatic/antifungal, gusset by incorporating wicking yarns and fibers into the fabric and chemically treating them with antibacterial/bacteriostatic/antifungal chemicals which the apparel includes.

a further object of the invention is to provide a method for producing a wicking, antibacterial/bacteriostatic/antifungal, low friction apparel by incorporating wicking, antibacterial/bacteriostatic/antifungal, low friction yarns and fibers into the fabric from which the apparel is made where only one side of the leg panel, that is, the right or left one, or either the top or bottom portion of the underarm gusset, have low friction fibers on the exterior surface.

a further object of the invention is to provide a method for producing apparel so that the panel or gusset which contains the antibacterial/bacteriostatic/antifungal, low friction yarns and fibers can be incorporated into any type of apparel a manufacturer wishes to make.

a further object of the invention is to provide a method for producing apparel so that the sewn in inner thigh panel which contains the antibacterial/-bacteriostatic/antifungal, low friction yarns and fibers can be incorporated into any type of apparel a manufacturer wishes independent of a wicking and antimicrobial/bacteriostatic/antifungal gusset.

a further object of the invention is to provide a method for producing apparel so that the underarm gusset which contains the antibacterial/-bacteriostatic/antifungal, low friction yarns and fibers can be incorporated into any type of apparel a manufacturer wishes independent of a wicking and antimicrobial/bacteriostatic/antifungal leg panel.

a further object of the invention is to provide a method for producing the wicking, antibacterial/bacteriostatic/antifungal, low friction panels and gussets which can either be utilized on cut and sew garments or in seamless garments should the manufacturer wish.

a further object of the invention is to provide a method for producing the wicking, antibacterial/bacteriostatic/antifungal, low friction panels and gussets in any type of legwear, be it ready to wear, active wear, hosiery, or any other type.

Although the description above contains many specificities, these should not be construed as limiting the scope of the invention but as merely providing illustrations of some of the presently preferred embodiments of this invention. For example, the gusset can have other shapes such as oval, trapezoidal, triangular, etc. The inner leg panels can be tailored to accommodate the various types of garments manufactured and can be made larger or smaller as size determines. It can also have other shapes, such as oval, trapezoidal, etc. The seams can be of any type. The length of the garment can be any type the manufacturer wishes. All parts of the garment may include stretch fibers for memory and shape retention. The amount of spandex can range from as little as 0% to as much as 40% for shapewear. The knits can be of any type such as, but not limited to, warp knits and circular knits. Circular knits, such as jersey knits, are ideal for bodywear, sportswear, and hosiery. Closures may be zippers, VELCRO®, buttons, snaps or any other type of closure the manufacturer wishes to utilize.

Thus the scope of the invention should be determined by the appended claims and their legal equivalents, rather than the examples given.

BRIEF DESCRIPTION OF THE DRAWINGS

While the specification concludes with claims particularly pointing out and distinctly claiming the subject matter which is regarded as forming the present invention, it is believed that the present invention will be better understood from the following description when taken in conjunction with the accompanying drawings in which:

FIG. 13 is a perspective view of the "cut and sew" garment in FIG. 12 showing the torso and leg portions that are to be attached to the "cut and sew" sewn in leg panel.

FIG. 14 is an enlarged detail of "cut and sew" sewn in panel in FIG. 10 that is attached to the "cut and sew" garment in FIG. 13 to form the garment.

FIG. 15 is a perspective view of FIG. 10.

FIG. 21 is a plated bra.

FIG. 22 is a plated knit skirt garment.

DETAILED DESCRIPTION OF THE PREFERRED EMBODIMENT

Description FIGS. 1-9

Figure 1A:
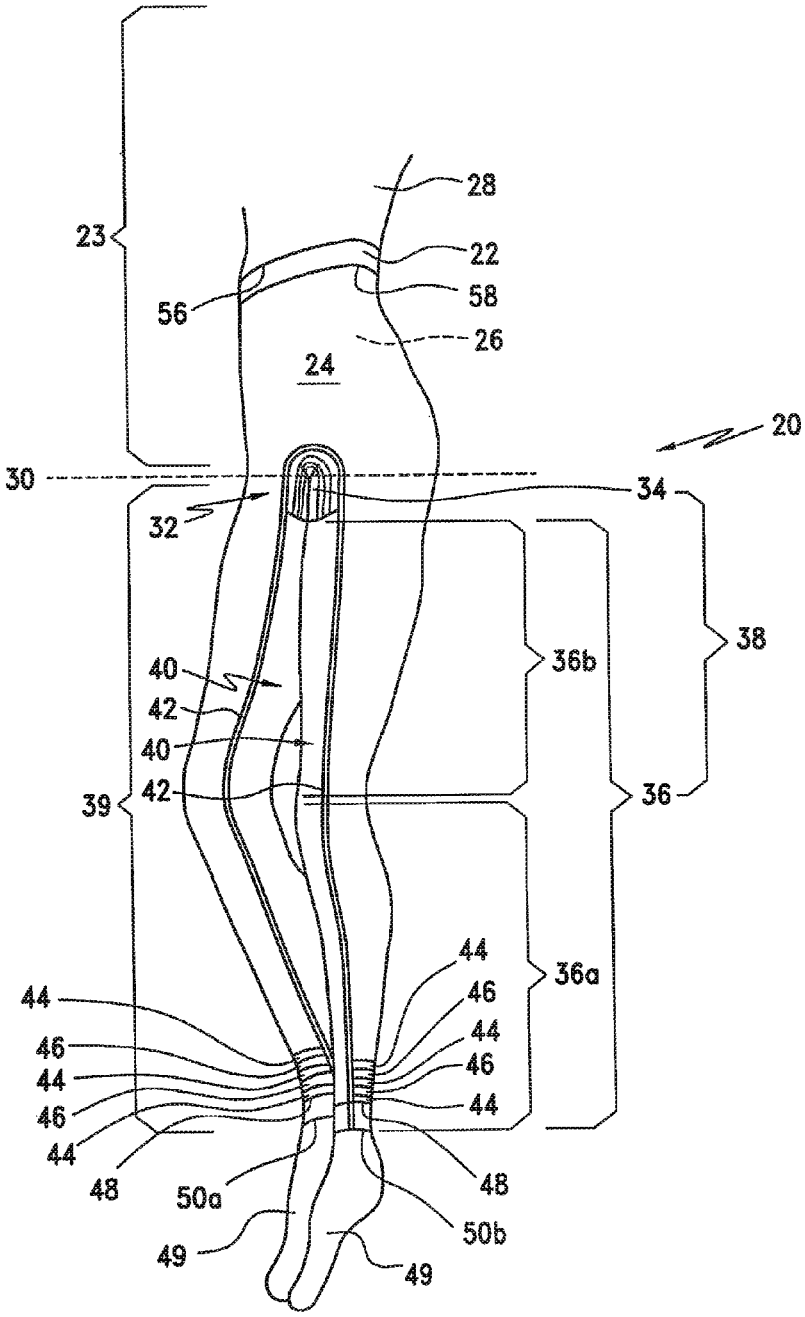
FIG. 1A is a three-quarter view of an ankle length seamless garment worn by a person in accordance with the teachings of this invention.

The novel features of the present invention are incorporated and illustrated in FIGS. 1A, 1B, 1C and FIG. 8. In general, the present invention is shown generally as a "seamless" washable garment 20. It is an improvement over prior garments for both men and women whether they are classified as underwear, shaping garments, hosiery, athletic garments, or ready-to-wear. A person 28 is wearing the garment 20 and comprises numbers 21 through 70. For purposes of clarity, like reference numerals are used where appropriate. The garment 20 is comprised of a torso portion 23 having a waistband 22 with a top 56 and a stitching line 58, a front portion 24, and a back portion 26. Further, the garment 20 contains a pair of leg portions of the garment 39 that are connected at a perforated line 30 and extend downwardly to the feet 49 of the person 28 wearing the garment 20. A region of the angle formed by the junction of the legs or crotch 32 and an inner part of the leg 40 is covered by a knit sewn in leg panel 38. Knit sewn in leg panel 38 is comprised of a crotch portion of sewn in panel 34, and an inner leg portion of knit sewn in leg panel 36 that will be further described in FIG. 5, FIG. 6, and FIG. 7. A front leg panel seam 42 connects the knit sewn in leg panel 38 to the torso portion of the garment 23 and to the leg portion of the garment 39 which in total forms garment 20. Alternating five rows of jersey stitches 44 and five rows of diamond-patterned stitches 46 are above the hem seam 48 that help hold the garment in place. First and second leg openings of the hem 50*a* and 50*b* respectively allow for an opening for the foot 49.

An important aspect of this invention is to provide the garment with the knit sewn in leg panel 38, which is generally shown in FIGS. 1A, 1B, 1C and FIG. 8, that eliminates an inner thigh seam, as being disposed of crotch portion 34 and an inner leg portion of knit sewn in leg panel 36. Knit sewn in leg panel 38 is sewn into garment 20 so as to overlay the inner part of leg 40 and crotch 32 of the person 28. The relative position of knit sewn in leg panel 38 is to cover the inner part of the leg 40 and is comprised of yarns that have stretch, wicking, friction reduction and antibacterial, antifungal, and or antimicrobial characteristics and will be further described in FIG. 5, FIG. 6 and FIG. 7.

The criteria for wicking yarns or fibers are as follows: Tactel®, a type of wicking yarn is used on the inside of the plated area and Tactel®, cotton, polyester, viscose, and or wool, for example, would be utilized on the outside of the plated areas. Or, a yarn or fiber with a higher DPF, denier per filament, is plated on the inside of a fabric, and a yarn or fiber with a lower DPF, is plated on the outside of a surface of a fabric. The higher DPF material has fatter, larger filaments and the lower DPF material has more smaller, thinner filaments. As a result the moisture on the inside of a person's skin is wicked away by the material with the larger DPF to the surface of the fabric with the lower DPF. The surface of the wetted area on exterior surface of the garment is greater than the surface of the wetted area on the inside. The result is that a person's skin stays dry.

Another method of producing wicking would be to plate fibers or yarns with different shapes together. For example, if moisture is on a person's skin, it will wick from a surface comprised of yarns or fibers that has few "lobes" or "clover leafed" shapes into a surface which is comprised of yarns or fibers that have many "lobes" or "clover leafed" shapes. The surface of the wetted area on the exterior surface of the garment is greater than the surface of the wetted area on the inside. The result is that a person's skin stays dry.

Figure 1B:
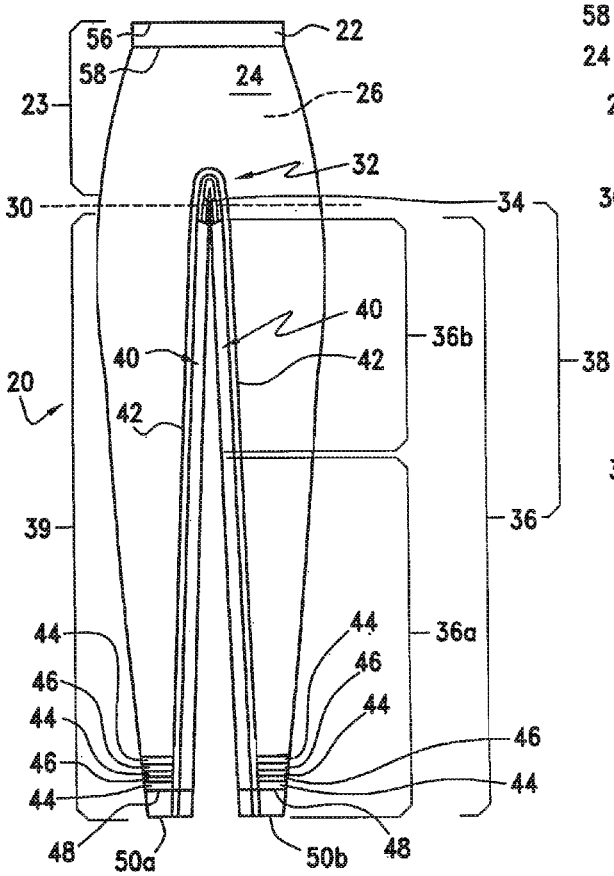
FIG. 1B is a representation of both the front and back views of FIG. 1A that are identical.

FIG. 1B is a representation of both the front and back views of FIG. 1A that are identical.

Figure 1C:
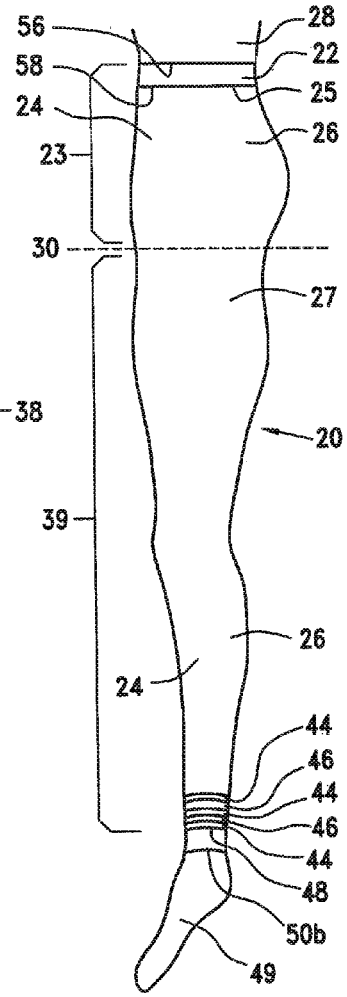
FIG. 1C is a side view of the garment as shown in FIG. 1A.

FIG. 1C is a side view of the garment as shown in FIG. 1.

Figure 2:
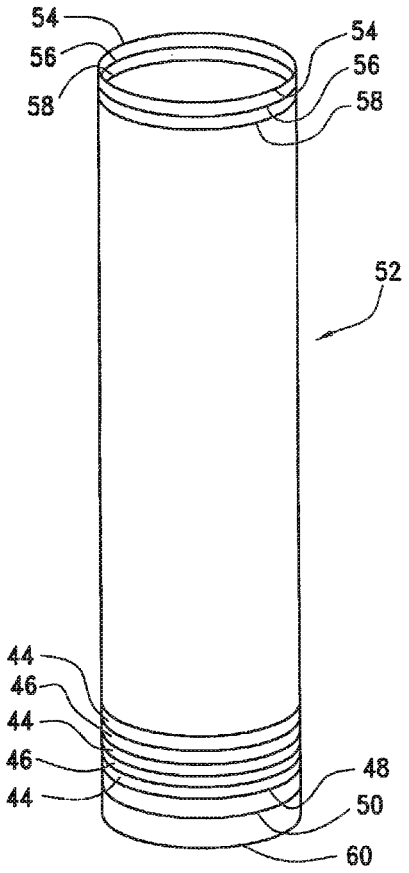
FIG. 2 is a view of a circular knit tube used to construct the seamless garment in FIGS. 1A, 1B, 1C and FIG. 8.

FIG. 2 represents a circular knit tube 52 out of which the seamless garment 20 is constructed. It is comprised of a top of circular knit tube 54, a top of the folded over waistband 56, and a waistband seam 58. A bottom of the circular knit tube 60 is folded up to hem seam 48 to form the first and second leg openings of hem 50*a* and 50*b* respectively. Alternating five rows of jersey stitches 44 and five rows of diamond-patterned stitches 46 are above the hem seam 48 that helps hold the garment in place but are at the manufacturers discretion and can be omitted or an alternative method for hemming the garment can be used.

Figure 3:
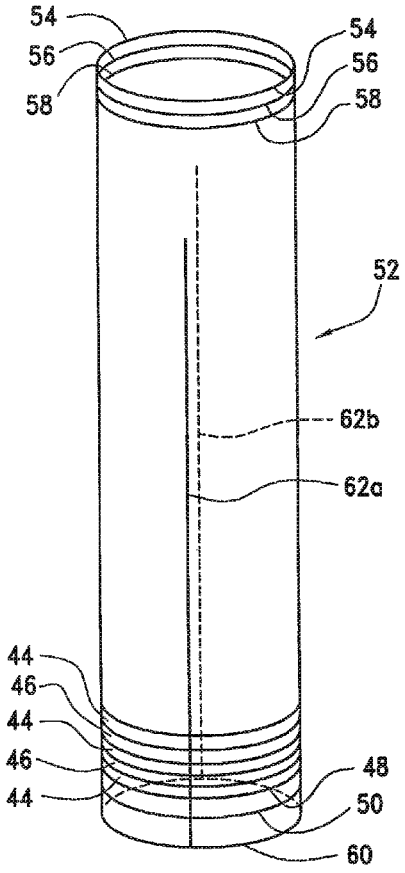
FIG. 3 is the front and back views of the circular knit tube showing the center cut lines, that when cut, forms the leg portions of the garment.
Figure 4:
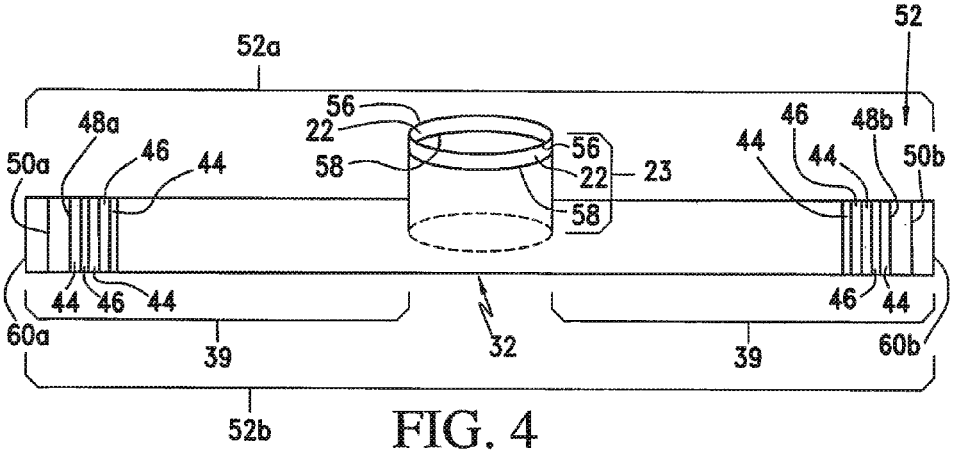
FIG. 4 is a perspective view of cut circular knit tube in FIG. 3 showing the torso and leg portions which are attached to the sewn in leg panel 38, comprised of sides 38*a* and 38*b*.

FIG. 3 represents the front and back views of the circular knit tube 52 showing the front and back center cut lines that are identical 62, that forms the leg portion 39 of the seamless garment 20 shown in a perspective view in FIG. 4.

FIG. 4 is a perspective view of cut circular knit tube in FIG. 3 showing the torso portion 23 and leg portions 39 of the garment 20. The torso portion 23 shows a folded over waistband 22 with a top 56 and a seam 58. The leg portions 39 have bottoms of the circular knit tube 60*a* and 60*b* which are folded up to hem seams 48*a* and 48*b* to form the first and second leg openings of hem 50*a* and 50*b* respectively after the knit sewn in leg panel 38 has been sewn in place. This will be further explained in FIG. 5. There is a crotch area 32 in between the leg portions of the garment 39. Alternating five rows of jersey stitches 44 and five rows of diamond-patterned stitches 46 are above the hem seam 48, which help hold the garment in place. The circular knit tube sides represented by 52*a* and 52*b* are for sewing purposes and are to be attached to sides of knit sewn in leg panel 38*a* and 38*b* to form the front and back leg panel seams 42 that are identical to form garment 20.

Figure 5:
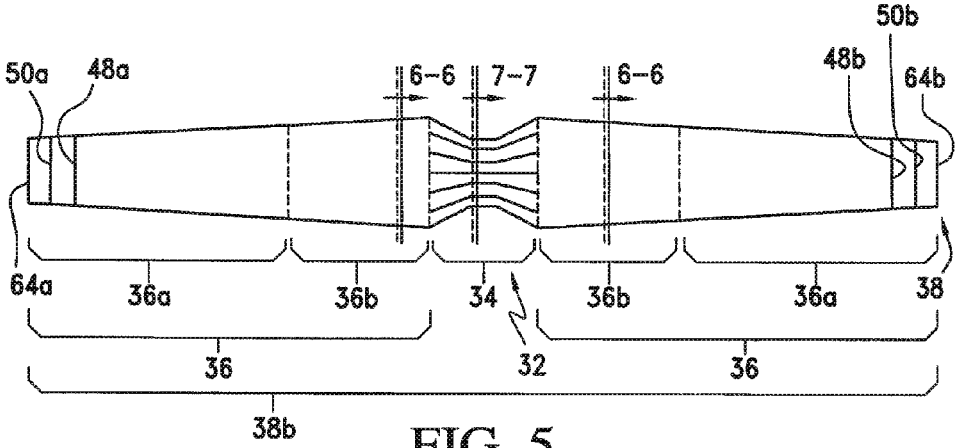
FIG. 5 is an enlarged detail of sewn in panel in FIGS. 1A, 1B, 1C, and FIG. 8 that is attached to the circular knit tube in FIG. 4 to form the garment.

FIG. 5 is an enlarged detail of knit sewn in panel 38 in FIGS. 1A, 1B, 1C and FIG. 8. The inner leg portion of knit sewn in leg panel 36 consists of a lower portion from an area from the ankle to above the knee 36*a*, and an upper portion from above the knee to the crotch area 36*b*. The crotch portion of sewn in panel 34 is smaller due to increased tension of the stitches in the crotch area 32. The tapering shape of the sewn in leg panel is dependent on the length of the garment but designed to cover an area of the inner part of the leg 40. Together both the inner leg portion of sewn in leg panel 36 and crotch portion 34 comprise the knit sewn in leg panel 38. Section lines 6-6 represent cross sections through the plated yarns in the upper portion of inner leg portion of the knit sewn in panel from an area above the knee to crotch 36*b* and will be further described in FIG. 6. Section lines 7-7 represent cross sections through the plated yarns in the crotch portion of the knit sewn in panel 34 and will be further described in FIG. 7. Hem seam 48*a* and 48*b* and the bottoms of the sewn in leg panel 64*a* and 64*b* form the first and second leg openings of the hem 50*a* and 50*b*. When the sides of sewn in knit panel 38*a* and 38*b* are sewn into the cut circular knit tube sides 52*a* and 52*b* the garment 20 is hemmed on the hem seams 48*a* and 48*b*.

Figure 6:
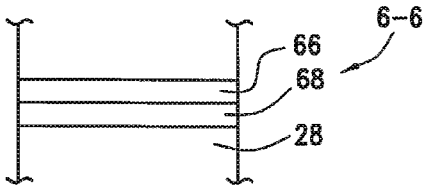
FIG. 6 is a cross section taken through section lines 6-6 on FIG. 5.

FIG. 6 is an enlargement of a cross section taken through section lines 6-6 in FIG. 5. An outer friction reducing yarn or fiber 66 is plated, (a knit fabric which has one kind of yarn on the face while another type is found on the back of the goods), over an inner wicking yarn or fiber 68. The placement of the yarns can also be accomplished by cutting the knit sewn in leg panel 34 from a woven double-faced fabric. The antifriction yarn is on the exterior of the garment and the wicking face is on the interior of the garment. An illustrative example of the friction reducing yarn may take the form of DuPont's® Teflon®, silicone, graphite, KYNAR ‰ boron, polypropylene, polyethylene, and GORETEX®. An illustrative example of a wicking yarn may take the form of DuPont's® Coolmax® and Aquator® fibers. The resulting knit fabric that makes up the knit sewn in leg panel 38 that is worn against the person's 28 skin. The wicking yarn 68 can be chemically treated to be antibacterial, antifungal, and bacteriostatic. To save the manufacturer money, the friction reducing yarn 66 can be plated on one side of the upper portion of the inner leg portion of the sewn in panel 38 to save money for the consumers without losing a decrease in function for the wearer.

Figure 7A:
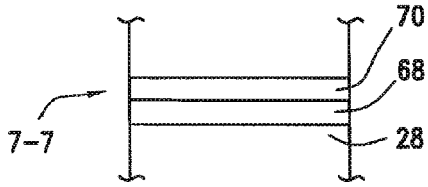
FIG. 7A is a cross section taken through section lines 7-7 on FIG. 5.

FIG. 7A is an enlargement of a cross section taken through section lines 7-7 in FIG. 5. An outer antibacterial, antifungal or bacteriostatic yarn or fiber 70 is plated over an inner wicking yarn or fiber 68. An illustrative example of the antibacterial, antifungal, and bacteriostatic yarn or fiber is Merrill's Skin Life®. The resulting knit fabric which makes up the crotch portion of sewn in panel 34 in knit sewn in leg panel 38 is worn against the person's 28 skin. The wicking yarns or fibers can be chemically treated to be antibacterial. antifungal or bacteriostatic and the antibacterial, antifungal, and bacteriostatic yarn eliminated to save money.

Figure 7B:
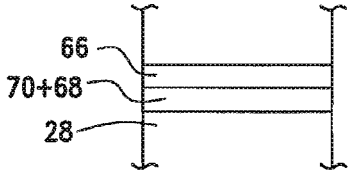
FIG. 7B is an alternate method of construction for the cross section taken through section lines 7-7 on FIG. 5.

FIG. 7B is an alternate method of construction for the cross section taken through section lines 7-7 on FIG. 5. An antibacterial, antifungal or bacteriostatic yarn or fiber 70 is knit with an inner wicking yarn or fiber 68. These two yarns are then plated with an outer friction reducing yarn or fiber 66. An illustrative example of the antibacterial, antifungal, and bacteriostatic yarn or fiber is Merrill's Skin Life®. The resulting knit fabric which makes up the crotch portion of sewn in panel 34 in knit sewn in leg panel 38 is worn against the person's 28 skin The wicking yarns or fibers can be chemically treated to be antibacterial, antifungal, and bacteriostatic and the antibacterial, antifungal, and bacteriostatic yarn eliminated to save money.

Figure 8:
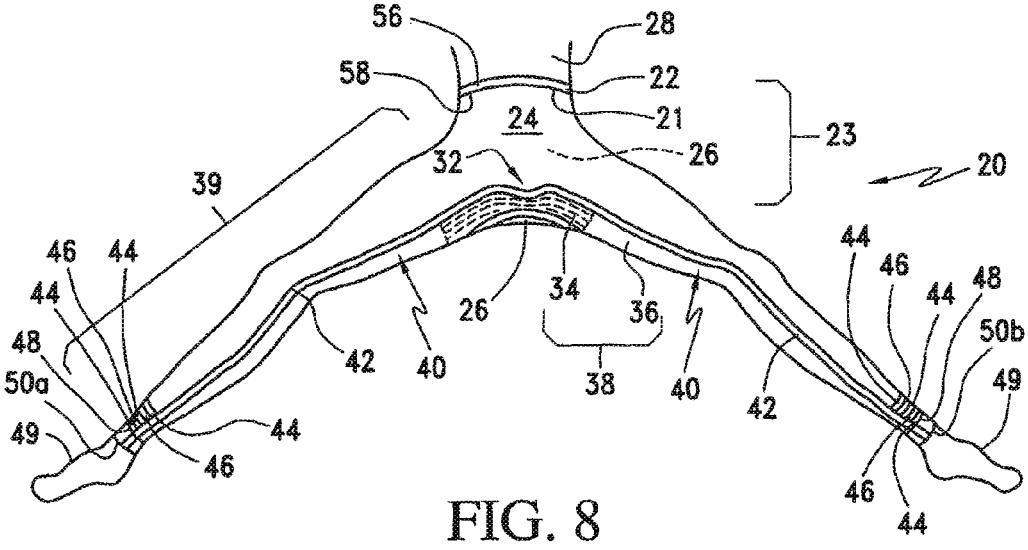
FIG. 8 is a perspective view of the sewn in leg panel in FIGS. 1A, 1B, and 1C.

A perspective view of the sewn in leg panel 38 in FIGS. 1A, 1B, and 1C is represented in FIG. 8. It is achieved by sewing the cut circular knit tube in FIG. 4 to the knit sewn in leg panel 38 in FIG. 5. Side 52*a* of the cut circular knit tube 52 is sewn to side 38*a* of the knit sewn in leg panel 38 and side 52*b* of the cut circular knit tube 52 is sewn to side 38*b* of the knit sewn in leg panel 38 to form seams 42 that are identical front and back. The garment is finished when the first and second leg openings of hem 50*a* and 50*b* are hemmed. This is accomplished by turning up the bottom of circular knit tube 60, 60*a* and 60*b*, and the bottoms of sewn in leg panel 64*a* and 64*b* and sewn on the hem seam 48. A first and second leg opening of hem 50*a* and 50*b* are thus formed. A detail of leg stitches and a leg opening of hem 50 is shown in FIG. 9.

Figure 9:
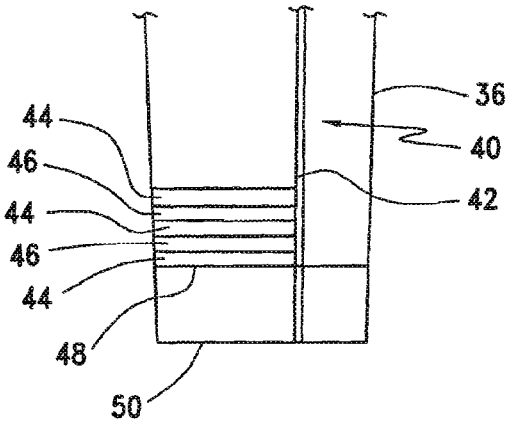
FIG. 9 is an enlarged detail of leg stitches and hem in FIG. 1A, 1B, 1C and FIG. 8.

FIG. 9 is an enlarged detail of leg stitches and hem in FIG. 1A, 1B, 1C and FIG. 8. Five rows of jersey stitches 44 and five rows of diamond patterned stitches 46 alternate and help hold the garment 20 in place. The stitches are not necessary for the function of the garment and are at the manufacturer's discretion. The lower portion of the inner leg panel from the ankle to above the knee 36*a* covers the inner part of the leg 40 at the leg panel seam 42. The hem seam 48 creates the leg openings of the hem 50.

Description FIGS. 10-15

Figure 10:
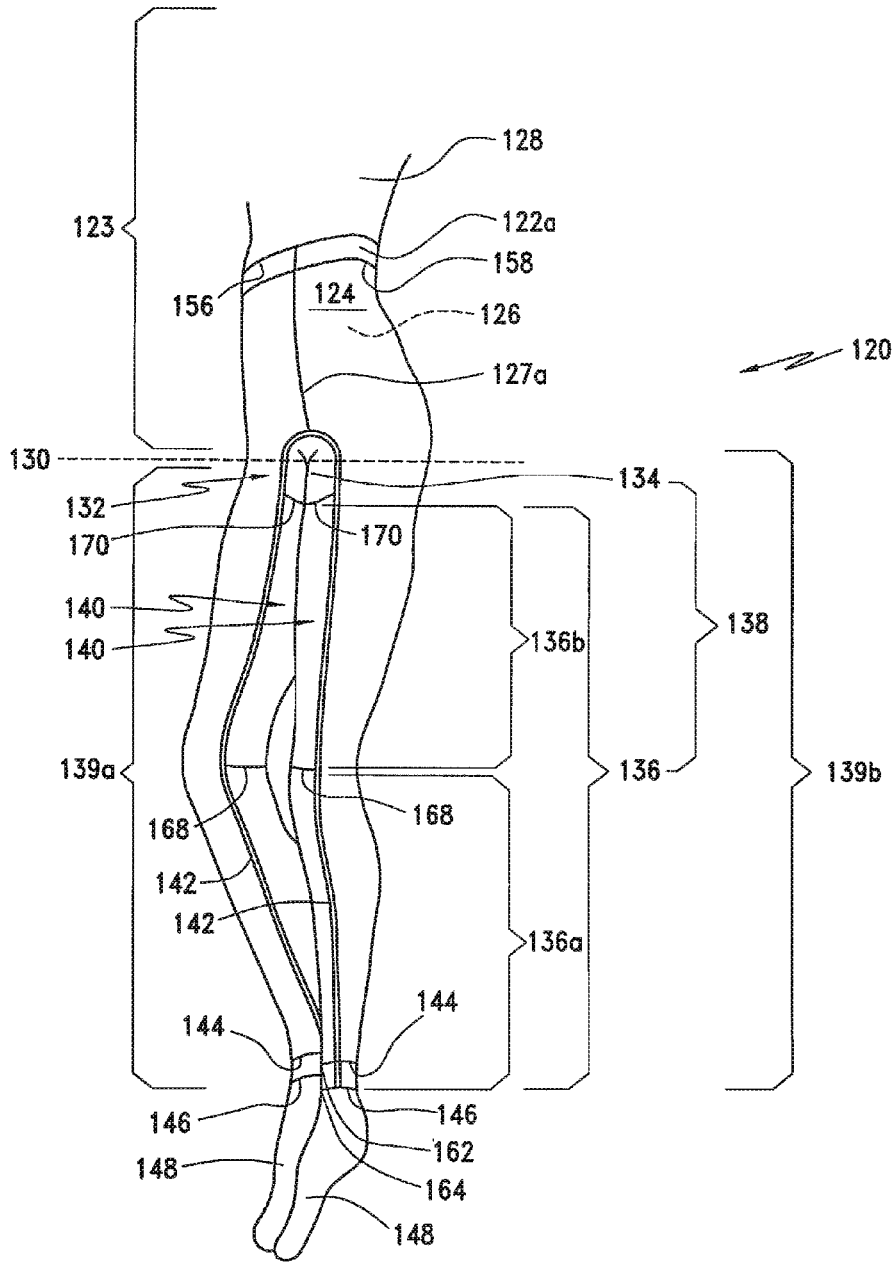
FIG. 10 is a three-quarter view of an ankle length "cut and sew" garment, worn by a person, in accordance with the teachings of this invention.

An additional embodiment is shown in FIG. 10. In this case the garment 120 is shown as a "cut and sew" garment with a "cut and sew" sewn in leg panel 138. The novel features of the "cut and sew" example of the present invention are incorporated and illustrated in FIGS. 10, 11A, 11B, 12, 13, 14, and 15. In general, the present invention is shown generally as a "cut and sew" washable garment 120. It is an improvement over prior garments for both men and women whether they are classified as underwear, shaping garments, hosiery or as athletic garments. A person 128 is wearing the garment 120 and comprises numbers 122 through 170. For purposes of clarity, like reference numerals are used where appropriate. The garment 120 is comprised of a torso portion 123 having a waistband 122 with a top 156 and a stitching line 158, a front portion 124, and a back portion 126. Further, the garment 120 contains a pair of leg portions of the garment 139 that are connected at a perforated line 130 and extend downwardly to the foot 148 of the person 128 wearing the garment 120. A region of the angle formed by the junction of the legs or crotch 132 and inner parts of the leg 140 is covered by a "cut and sew" sewn in leg panel 138. "Cut and sew" sewn in leg panel 138 is comprised of a crotch portion of sewn in panel 134 and an inner leg portion of the "cut and sew" sewn in panel 136 that will be further described in FIG. 14. The garment 120 has a torso center front and back seams 127*a* and 127*b* respectively. A front and back leg panel seams 142*a* and 142*b* respectively connects the "cut and sew" sewn in leg panel 138 to the torso portion of the garment 123 and to the leg portion of the garment 139*a* and 139*b*, right and left respectively, which in total forms garment 120. Leg openings of hem 146 are formed when the hem of the pattern pieces of the garment 162 and the hem of "cut and sew" sewn in panel 164 and stitched to the hem seam 144.

An important aspect of this invention is to provide the garment with the "cut and sew" sewn in leg panel 138, that eliminates the need for an inner thigh seam, which is generally shown in FIG. 10 as being disposed of crotch portion 134 and an inner leg portion of sewn in panel 136. "Cut and sew" sewn in leg panel 138 is sewn into garment 120 so as to overlay the inner part of leg 140 and crotch 132 of the person 128. The relative position of the "cut and sew" sewn in leg panel 138 is to cover the inner part of the leg 140 and is comprised of materials that have stretch, wicking, friction reduction, and antibacterial or antimicrobial characteristics and will be further described in FIG. 14.

Figure 11A:
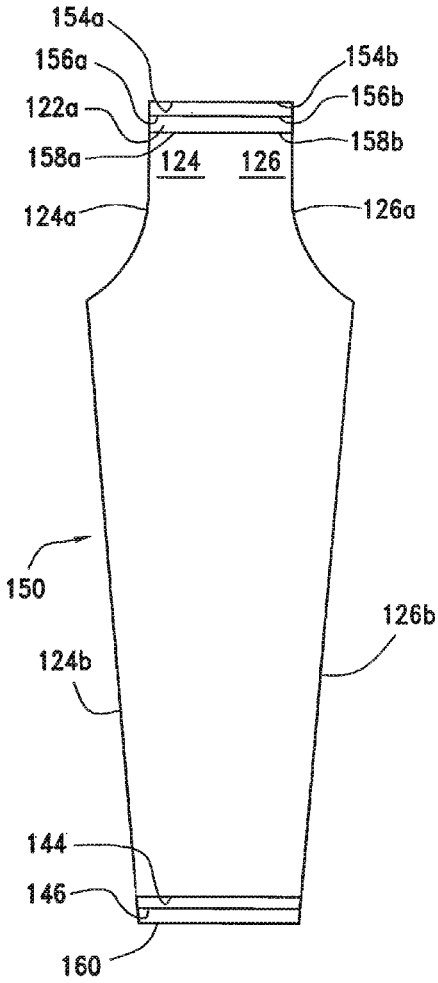
FIG. 11A is the right pattern piece of a "cut and sew" garment.
Figure 11B:
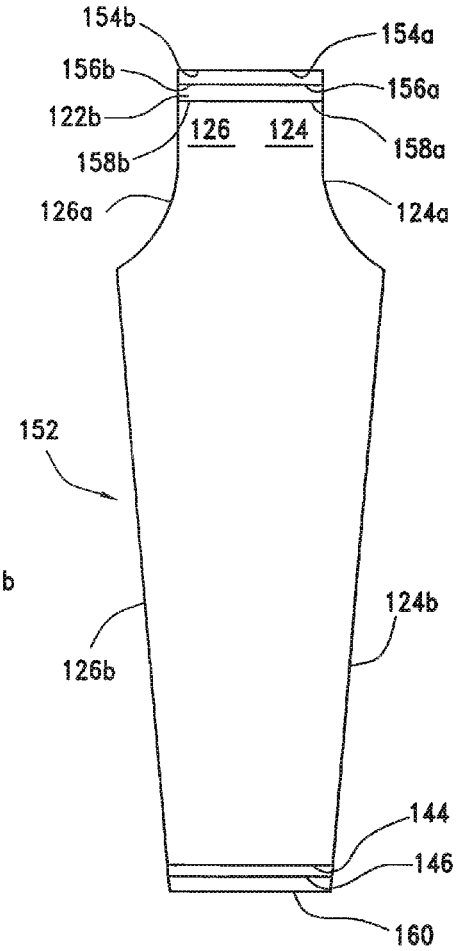
FIG. 11B is the left pattern piece of a "cut and sew" garment.

FIG. 11A and FIG. 11B are a representation of the front and back views of the pattern pieces used to construct the "cut and sew" garment 120 in FIG. 10 and FIG. 15 that are identical. The front of the pattern piece 150 of "cut and sew" garment 120 and the back of the pattern piece 152 of "cut and sew" garment 120 are comprised of "cut and sew" pattern piece top, 154*a* and 154*b*, representing front and back respectively. Top of folded over waistband, 156*a* and 156*b*, representing front and back respectively and the waistband seam, 158*a* and 158*b*; representing front and back respectively, comprise the waistband. Both the right pattern piece FIG. 11A and the left pattern piece FIG. 11B have front and back sides to them. The fronts of the pattern pieces 124 of "cut and sew" garment 150 are comprised of two portions, the torso front portion of pattern pieces 124*a* and the leg front portions of pattern pieces 124*b*. The backs of the pattern pieces 126 of "cut and sew" garment 152 are comprised of two portions, the torso back portions of pattern pieces 126*a* and leg back portions of pattern pieces 126*b*. Both pattern pieces have a hem seam 144, a leg opening of hem 146, and a bottom of pattern pieces, 160*a* and 160*b*, representing front and back respectively.

Figure 12:
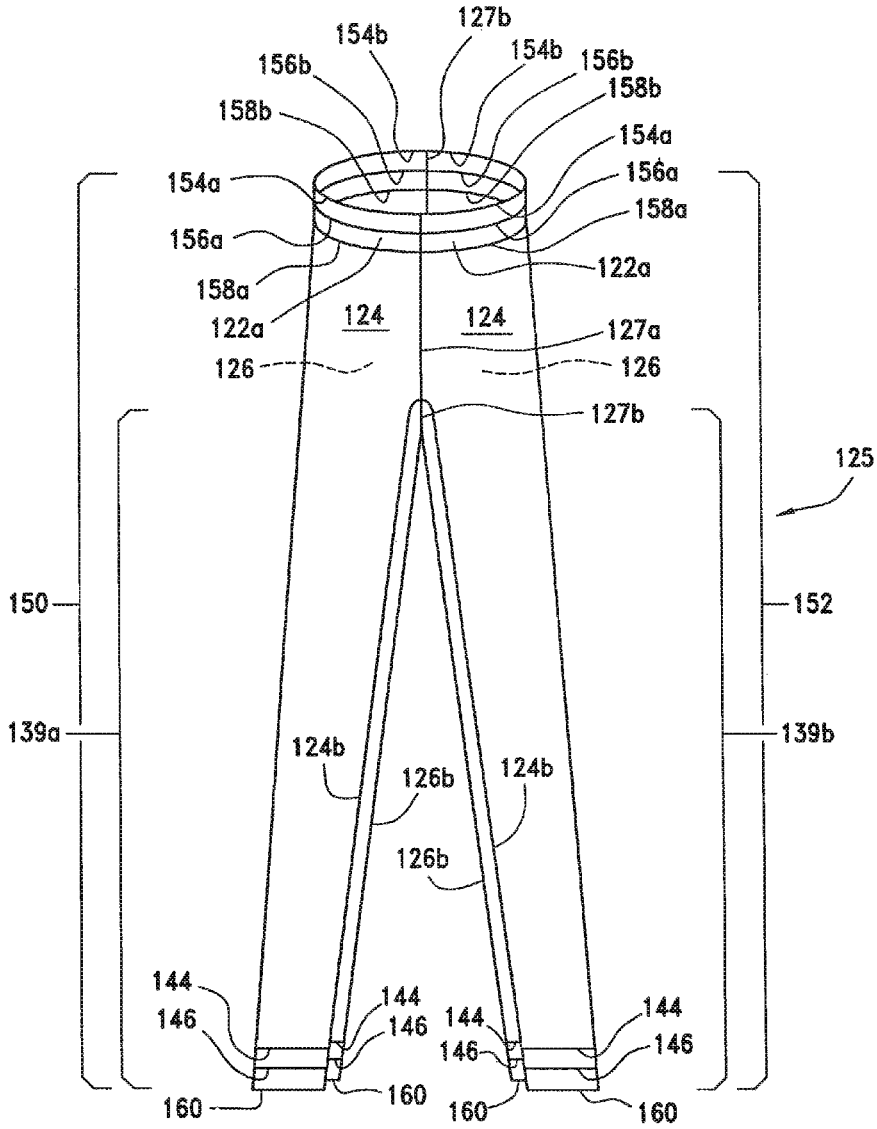
FIG. 12 is a view of the front and back pattern pieces of a "cut and sew" garment sewn together, front to back, in the torso area.

Sewn together front and back pattern pieces without the sewn in leg panel 125 is represented in FIG. 12. The garment is comprised of the same elements that are contained in FIG. 11A and FIG. 11B. The only additional components are torso center front and back seam, 127*a* and 127*b* respectively. The front seam 127*a* holds the front portions of pattern pieces 124*a* together. The torso center back seam 127*b* hold the back portion of pattern pieces 126*a* together.

A perspective view of the sewn together front and back pattern pieces without the sewn in leg panel 125 is represented in FIG. 13. It is achieved by sewing the front portions of pattern pieces, 124*a* and 124*a* of FIG. 11A and FIG. 11B respectively together at the torso center front 127*a* as well as the back portion of pattern pieces 126*a* and 126*b* respectively to form the torso center back seam 127*b*. In this view the folded over waistband 122, 122*a* and 122*b* representing front and back respectively, is created when the top of folded over waist and 156*a* and 154*b*, representing front and back respectively, is folded over and is sewn down on the waistband seam, 158*a* and 158*b* representing front and back respectively. The torso portion of garment 123 and the leg portions of the garment 139*a* and 139*b*, right and left respectively, comprise the "cut and sew" garment 121. The front leg openings 124*b* and the back leg openings 126*b* are the areas the "cut and sew" sewn in leg panel 138 is to be attached. The other parts are identical to those previously described in FIG. 11A and FIG. 11B.

FIG. 14 is an enlarged detail of "cut and sew" sewn in panel 138 in FIG. 10, and FIG. 15. The inner leg portion of sewn in panel 136 consists of a lower portion from an area above the ankle to the knee 136*a* and an upper portion from above the knee to the crotch area 136*b* that are stitched together at seam 168. The crotch portion of sewn in panel 134 connects the leg portions of the "cut and sew" sewn in panels 136. The upper portion from above the knee to the crotch area 136*b* is sewn to the crotch panel 134 by the seams represented by 170. Together both the inner leg portion of the "cut and sew" panel 136 and crotch portion 134 comprise the "cut and sew" sewn in leg panel 138 the sides of which are represented by 138*a* and 138*b* for sewing purposes. The tapering shape of the sewn in leg panel is dependent on the length of the garment but designed to cover an area of the inner part of the leg 140 and eliminates an inner thigh seam. The panel sections from the ankle to above the knee 136*a* are comprised of the same material as the body of the garment and are connected to an upper portion from above the knee to the crotch area 136*b* by a seam 168. The seam 170 holds the upper portion of "cut and sew" leg panel 136*b* to the crotch portion of the panel 134.

The panel sections from above the knee to the crotch area 136*b* are comprised of a knit plated or knit double-faced fabric that wicks on the inside and is slick on the exterior of the garment. The slickness of the exterior reduces friction between the legs for the wearer. The crotch portion of sewn in panel 134 is comprised of a wicking material that is treated with an anti-bacterial, antifungal and or bacteriostatic chemical to reduce infections and odors for the wearer. Or, it is plated as well, with a wicking fiber on the inside and an anti-bacterial, antifungal or bacteriostatic fabric on the outside. In both the upper portions from above the knee to the crotch area 136*b* and the crotch panel 134 the wicking yarns can be chemically treated to be antibacterial, antifungal, and bacteriostatic. To save money for the manufacturer, the friction reducing yarn can be plated on one side only of the upper portion from above the knee to the crotch area 136*b* to save money for the manufacturer and the consumer without loosing a decrease in function for the wearer. The hem seam of "cut and sew" panel 162, leg opening of "cut and sew" sewn in panel 164 and bottom of "cut and sew" sewn in leg panel 166 finish the sewn in leg panel 138.

A perspective view of the sewn in leg panel 138 in FIG. 10 is represented in FIG. 15. It contains all of the elements as in FIG. 10. The garment 120 is made by sewing together front and back pattern pieces shown in FIG. 13 to the sewn in leg panel shown in FIG. 14. Leg front portions of pattern pieces 124*b* of the sewn together front and back pattern pieces without the "cut and sew" sewn in leg panel 125 are sewn to side 138*a* of the "cut and sew" sewn in leg panel 138. Leg back portions of pattern pieces 126*b* of the sewn together front and back pattern pieces without the "cut and sew" sewn in leg panel 125 are sewn to side 138*b* of the "cut and sew" sewn in leg panel 138. This forms the front and back leg panel seams 142. The garment is finished when the bottoms of pattern pieces 160 and the bottom of "cut and sew" sewn in leg panel 164 are turned up and sewn down on the hem seam 144 and on the hem seam of "cut and sew" sewn in leg panel 162 to create the leg opening of hem 146.

Description of FIGS. 16A-17B

The knit sewn in leg panel 38 and the "cut and sew" sewn in leg panel 138 can be made part of any type of garment whether it is seamless or "cut and sew" and there are various possibilities regarding the design of the garments that can utilize the sewn in leg panel 138 whether of a knit or "cut and sew" construction.

Figure 16A:
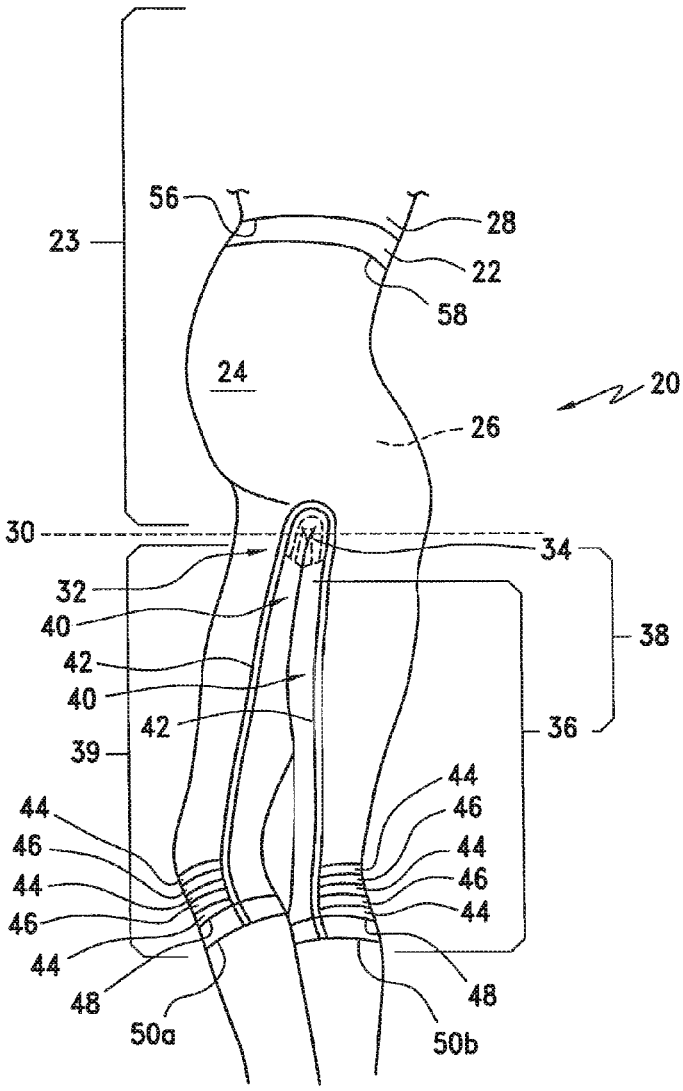
FIG. 16A is a three-quarter view of a maternity seamless garment worn by a woman with a midriff waistline that is below the knee length.
Figure 16B:
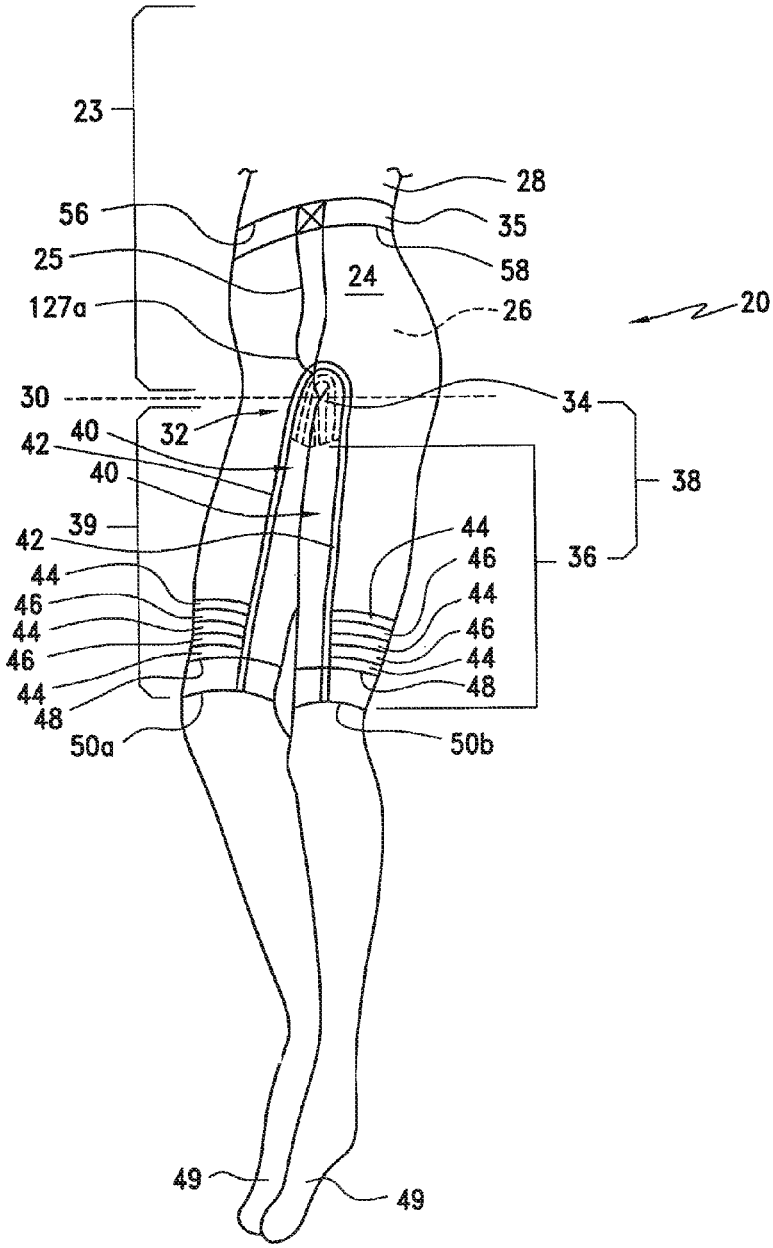
FIG. 16B is a three-quarter view of a seamless garment worn by a man with a natural waistline, is above the knee length, has a separate sewn on waistband, and a fly front closure.
Figure 16C:
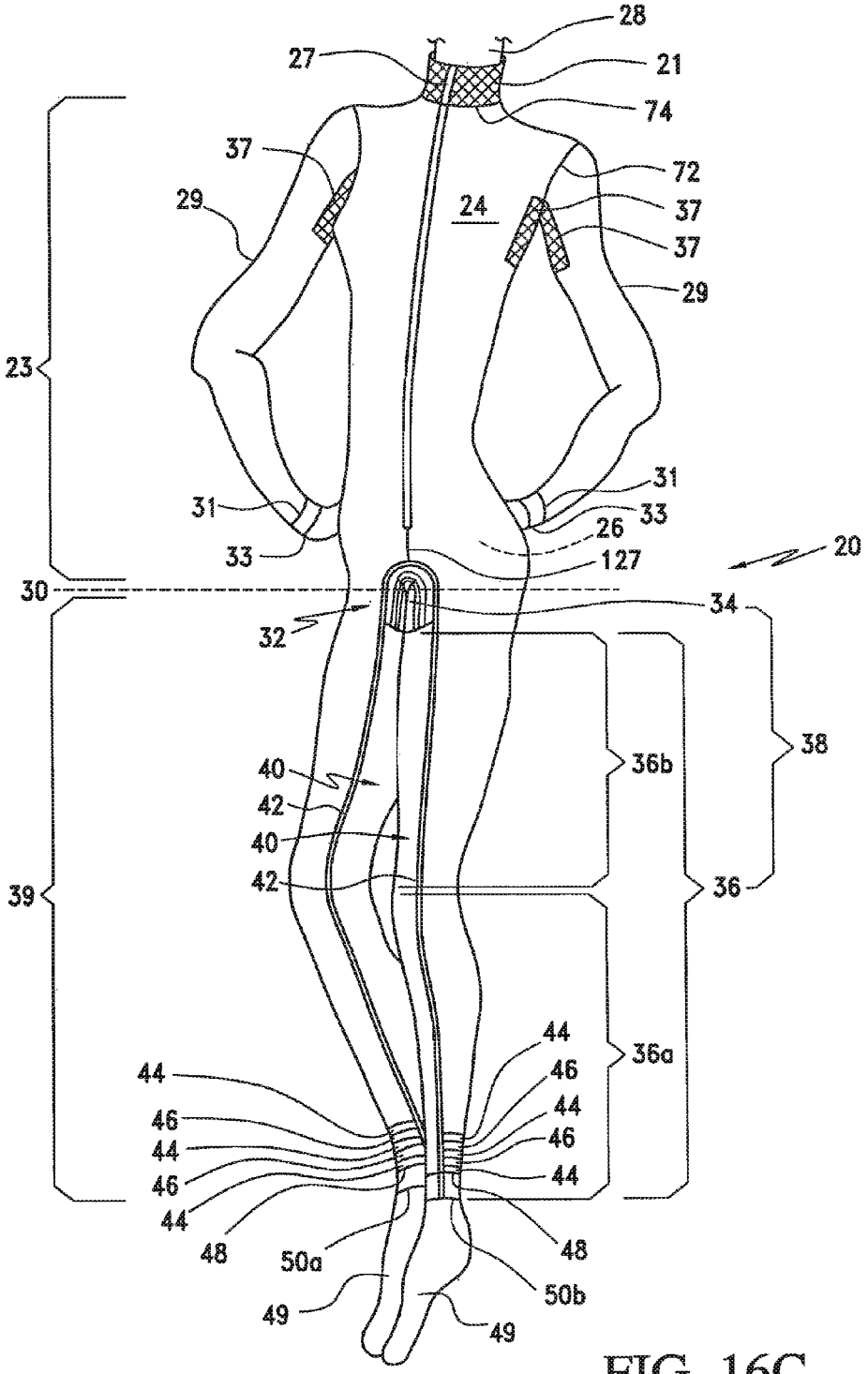
FIG. 16C is a three-quarter view of a seamless garment, worn by a woman, with a turtleneck styled collar, long sleeves, and front zipper closure.

Some examples of the types of garments that can utilize the knit seamless sewn in leg panel are represented in FIGS. 16A-16C. Unless stated otherwise they contain the elements as in FIGS. 1-A, 1-B 1-C, and 10 previously identified.

A three-quarter view of a maternity seamless garment worn by a woman, with a waistline 22 in the midriff area, and is below the knee length is represented in FIG. 16A. A three-quarter view of a seamless garment worn by a man with a natural waistline 22, is an above the knee length, has a separate sewn on waistband 35, and a fly front closure 25 is represented in FIG. 16B. A three-quarter view of a seamless garment worn by a woman with a plated turtleneck styled collar 21 has been added to the garment that is the same construction as the knit sewn in leg panel 38, a turtleneck seam 74, long sleeves 29 attached to the garment 20 by a armhole seam 72 and front zipper closure 27 is represented in FIG. 16C. A plated underarm gusset 37 has been added to the garment that is the same construction as the knit sewn in leg panel 38 comprised of the chemically treated antibacterial or antimicrobial wicking and friction reduction yarns or fibers.

Figure 17A:
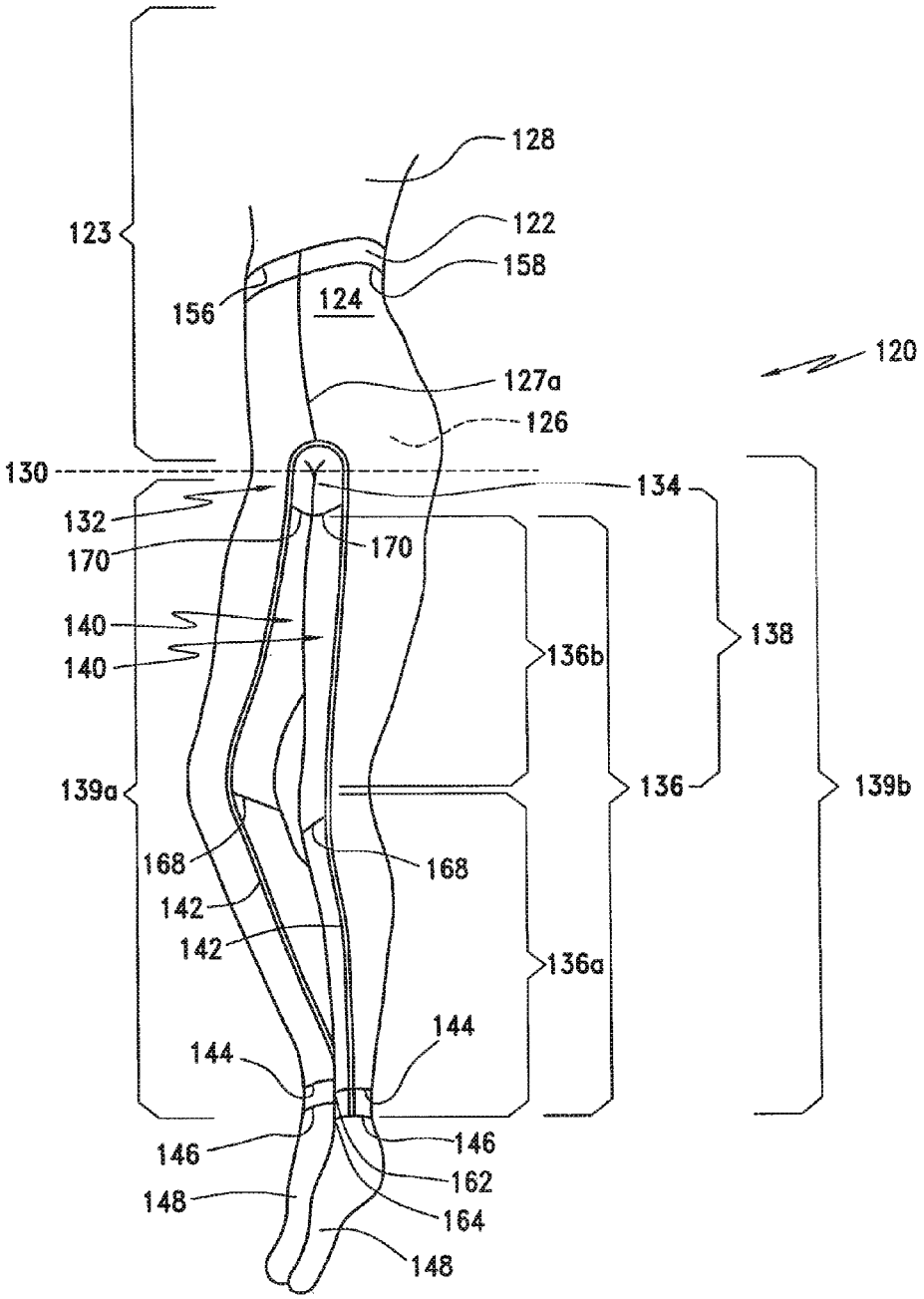
FIG. 17A is a three-quarter view of a "cut and sew" garment worn by a woman with a bikini waistline, is ankle length, and has oblique below the knee seaming for the "cut and sew" sewn in panel.
Figure 17B:
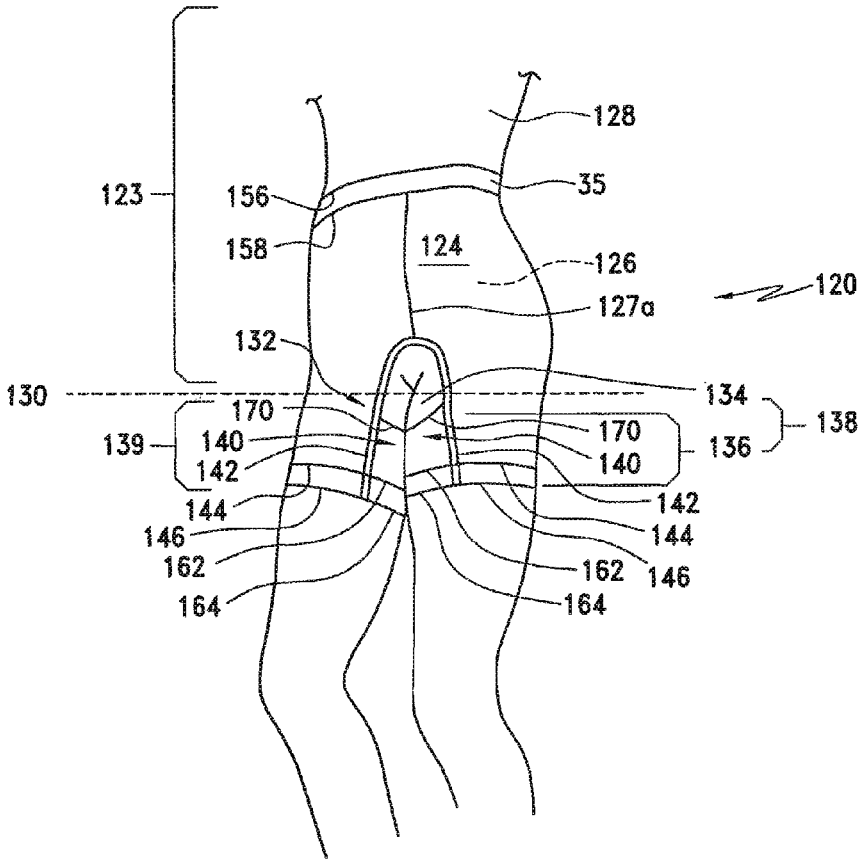
FIG. 17B is a three-quarter view of a "cut and sew" garment worn, by a woman, with a separate sewn on waistband at the natural waistline, and is a boy cut length.

The "cut and sew" sewn in leg panel 138 can also be utilized in "cut and sew" garments as represented in FIGS. 17A and 17B. Unless stated otherwise they contain the elements in FIGS. 10 and 15 previously identified.

A three-quarter view of a "cut and sew" garment worn by a woman with a waistline 22 in the "bikini" position, is ankle length, and has an oblique below the knee seam 168 detail on the "cut and sew" sewn in leg panel 138 is represented in FIG. 17A.

A three-quarter view of a "cut and sew" garment worn by a woman with a natural waistline, and is a boy cut length with a separate sewn on waistband 35 is represented in FIG. 17B.

Description of Style Options

The FIGS. 16A-17B illustrate the point that the knit sewn in leg panel 38 and the "cut and sew" leg panel 138 can be sewn into any type of garment whether classified as underwear, shaping garments, athletic or ready-to-wear. Two methods can be utilized to construct them. The first method is to knit a antibacterial, antifungal and or bacteriostatic yarn or fibers 70 with an inner wicking yarn or fiber 68 together with a friction reducing yarn or fiber 66 so that the wicking/antibacterial, antifungal, antimicrobial layer is against the skin and the friction reducing yarn or fiber is on the outer surface of the garment 120. The second method is to knit the wicking yarn or fiber 68 together with a friction reducing yarn or fiber 66 so that the wicking layer is against the skin and the friction reducing yarn or fiber is on the outer surface of the garment 120. The wicking yarns can then be chemically treated to be antibacterial, antifungal, and or bacteriostatic. Garments can have any style of waistband whether a folded over waistband 22 or separate sewn on waistband 35. The placement of the waistband determines the "design style" of the garment. Examples of waistband 22 or separate sewn on waistband 35 placement include "bikini", "tanga", "French cut", "midriff style", "American", "natural", "Japanese" or any placement variation thereof. If the garment 20 is "seamless" and has a waistband 22, it can be knit into the garment 20, folded over and hemmed. The waistband 22 can also be knit into the garment with a different type of stitch construction and the top edge of the waistband 22 can be finished on the knitting machine If the garment 20 is a "cut and sew" type the waistband 22 is folded over and sewn down forming a casing. This type of waistband 22 may or may not contain elastic or any other type of stretch materials. On both types of garment 20, "seamless" and "cut and sew", the waistband can also be sewn on separately. When a separate sewn on waistband 35 is sewn on it can also be made of elastic or any other type of stretch material. The garment 20 can also be constructed as a full bodysuit, see FIG. 16C, and the waistband 22 can be omitted altogether.

The garment 20 can have any type of identifying label sewn onto the back of the waistband 22. If the garment 20 is "seamless" and has a waistband 22, it can be knit into the waistband 22. Identifying information can be heat sealed onto the waistband 22. The garments 20 and 120 can be any length, "boy cut", "mid-thigh", "three-quarter thigh", "above the knee", "below the knee", "Capri", "flood", "midi", "ankle", or any variation of the length up or down the leg. The garments 20 and 120 can also be manufactured without legs, for example as a "thong", and any other version thereof, and only contain the unique features of the crotch portion of knit sewn in panel 34 and the crotch portion of "cut and sew" sewn in leg panel 134.

To help prevent the garment 20 from riding up the leg, in the knit "seamless" construction, five rows of jersey stitches 44 and five rows of diamond-patterned stitches 46 can be incorporated into the garment 20 but are not mandatory. The type of stitches at the hemline can be changed at the manufacturer's discretion to prevent the garment from riding up or down the leg. The alternating five rows of jersey stitches 44 and five rows of diamond-patterned stitches 46 are not mandatory for the function of the garment. Other types of materials, such as a silicone strip, may also be added to the inside of the hems 48 and 144 to prevent them from riding up at the manufacturers discretion. The "cut and sew" versions of the garment 120 do not contain these stitches. First and second leg opening 50*a* and 50*b* respectively of hem 50 can have any detailing the manufacture wishes to incorporate into the garment 120 to hold the garment in place such as a strip of silicone. Other types of seam placement such as princess seams on the torso portion of the garment 23 are also at the manufacturer's discretion and will not affect the function of the knit sewn in leg panel 38 or the "cut and sew" sewn in leg panel 138.

The shape of the knit sewn in leg panel 38, that eliminates the need for an inner thigh seam, can be long and rectangular, short and rectangular, hourglass, tapered or not depending on the length of the garment 20. In a "seamless" version of garment 20 the crotch portion of sewn in panel 24 may be made narrower to form the hourglass shape by increasing the tension on the stitches in the crotch portion of the sewn in panel 24. On an ankle length version of garment 20, the hem 50, can be made narrower. This can be accomplished by increasing the tension in the stitches at the hem 50. Cutting the lower portion of the inner leg portion of the knit sewn in leg panel from an area from the ankle to above the knee in a tapered fashion out of knit tubular fabric will also accomplish a tapered effect. If the knit sewn in leg panel 38 is knit as a separate piece, and is not cut from a long tubular piece of fabric, the number of stitches may be increased or decreased, as the pattern requires achieving the desired shape. The shape of the knit sewn in leg panel 38 will vary depending on the size and length of the garment 20 but the pattern should always be cut to cover the part of leg and crotch of body 40 to be functional. It can be cut to cover an area larger than the inner part of leg and crotch of body however if the manufacturer wishes.

Regarding the "cut and sew" sewn in leg panel 138 required for a "cut and sew" garment, once again, the pattern piece is cut in a tapered hourglass shape for an ankle length version of garment 20. The shape of the sewn in leg panel 138 will vary depending on the size and length of the garment 120 but the pattern should always be cut to cover the part of leg and crotch of body 140 to be functional. It can be cut to cover an area larger than the inner part of leg and crotch of body 140 however if the manufacturer wishes.

Description FIGS. 18A-19E

Figure 18A:
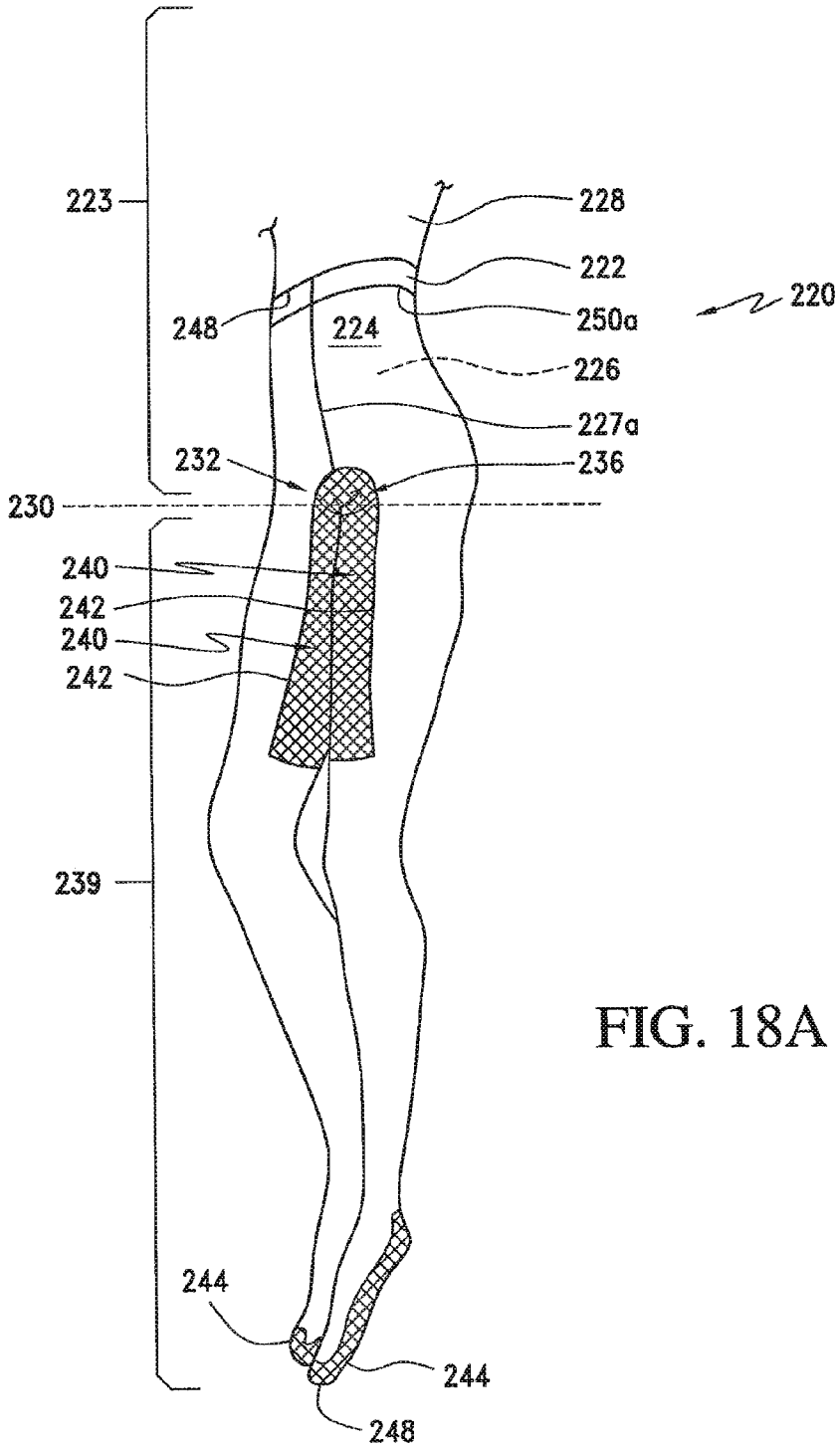
FIG. 18A is a three-quarter view of a pair of pantyhose, with a plated area on the inner thigh area, a plated crotch, and a plated bottom and sides of a foot.

Another embodiment of the present invention is incorporated and illustrated in FIGS. 18A-19E. In general, the present invention in FIGS. 18A and 18B is shown generally as a pair of washable pantyhose with plated inner thigh area, plated crotch and plated bottom and sides of foot or garment 220. It is an improvement over prior pantyhose. A person 228 is wearing the garment 220 and comprises numbers 220 through 250. For purposes of clarity, like reference numerals are used where appropriate. The garment 220 is comprised of a torso portion 223 having a waistband 222, with a top of folded over waistband 248, a seam of folded over waistband 250, a front portion 224, and a back portion 226. Torso center front and back seams, 227*a* and 227*b* respectively, hold the two torso portions of the pantyhose 223 together. Further, the garment 220 contains a pair of leg portions of the garment 239 that are connected at a perforated line 230 and extend downwardly to the plated bottom and sides of foot 244 of the person 228 wearing the garment 220. The plated bottom and sides of foot 244 has a toe seam 245. A plated crotch gusset 236, which will be further described, in FIG. 19D and FIG. 19E, covers a region of the angle formed by the junction of the legs or crotch 232. A plated knit inner thigh leg area 242, of the garment 220, and a plated crotch gusset 236, covers an inner part of the leg 240. Plated inner thigh knit leg area 242 is adjacent to a plated crotch gusset 236 that will be further described in FIG. 19D and FIG. 19E.

Figure 18B:
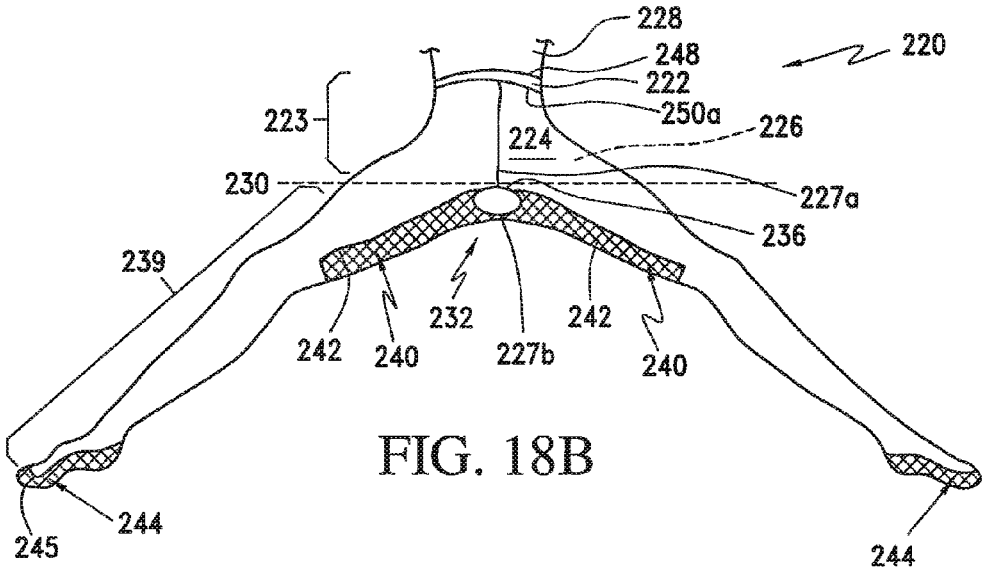
FIG. 18B is a perspective view of a pair of pantyhose with a plated area on the inner thigh area, a plated crotch, and a plated bottom and side of a foot.

An important aspect of this invention is to provide the garment with the plated knit inner thigh leg area 242, and plated crotch gusset 236, which is generally shown in FIGS. 18A, 18B. Plated knit inner thigh leg area 242, is knit into garment 220 so as to overlay the inner part of leg 240 of the person 228. The relative position of plated knit inner thigh leg area 242, is to cover the inner part of the leg 240 and is comprised of yarns that have stretch, wicking, antibacterial or antimicrobial, and friction reduction properties. This will be further described in FIG. 19B and FIG. 19G. The plated crotch gusset 236 is comprised of fibers that have wicking and antibacterial or antimicrobial characteristics and or friction-reducing properties will be further described in FIG. 19E, and FIG. 19F.

Tactel®, a type of wicking yarn is used on the inside of the plated area and Tactel®, cotton, polyester, viscose, and or wool, for example, would be utilized on the outside of the plated areas. Or, a yarn or fiber with a higher DPF, denier per filament, is plated on the inside of a fabric, and a yarn or fiber with a lower DPF, is plated on the outside of a surface of a fabric. The higher DPF material has fatter, larger filaments and the lower DPF material has more smaller, thinner filaments. As a result the moisture on the inside of a person's skin is wicked away by the material with the larger DPF to the surface of the fabric with the lower DPF. The surface of the wetted area on exterior surface of the garment is greater than the surface of the wetted area on the inside. The result is that a person's skin stays dry.

Another method of producing wicking would be to plate fibers or yarns with different shapes together. For example, if moisture is on a person's skin, it will wick from an surface comprised of yarns or fibers that has few "lobes" or "clover leafed" shapes into a surface which is comprised of yarns or fibers that have many "lobes" or "clover leafed" shapes. The surface of the wetted area on exterior surface of the garment is greater than the surface of the wetted area on the inside. The result is that a person's skin stays dry.

FIG. 18B is a perspective view of garment 220 in FIG. 18A showing the torso portion 223 and leg portions 239 of the garment 220. The torso portion 223 shows a folded over waistband 222 with a top 248 and a seam 250. The leg portions 239 have a plated bottom and sides of foot 244 and a toe seam 245. The front portions of the garment 224 are sewn together at the torso center front seam 227*a* and the back portions of garment 226 is sewn together at the torso center back seam 227*b*. There is a plated crotch gusset 236 in a region of the angle formed by the junction of the legs or crotch 232. This will be further explained in FIGS. 19E and 19F. A plated knit inner thigh leg area 242. in the garment 220 covers the inner portion of the leg 240. This will be further explained in FIGS. 19B and 19G. The plated bottom and sides of foot 244 and the toe seam 245 complete the garment.

Figure 19A:
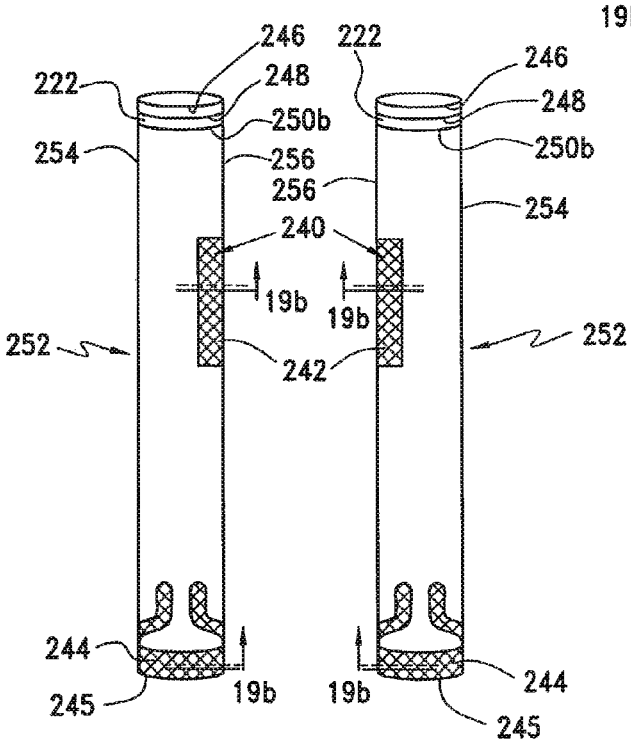
FIG. 19A are seamless knit tubes with plated wicking inner thigh sections and a plated bottom and sides of a foot.

FIG. 19A is a representation of the circular knit tubes 252 out of which the pantyhose garment 220 is constructed. They are comprised of a circular knit tube tops 246, tops of the folded over waistband 248, and waistband seam placement 250*b* that form the waistband 222. The outer sides of knit tubes forming pantyhose garment 254, and the inner side of knit tubes 256, comprises the tubes. A portion of the tube is knit in a plated manner and creates a plated knit inner thigh leg area 242. This plated knit inner thigh leg area 242. is designed to cover the inner part of leg 240. A cross section through the plated knit inner thigh leg area 242 and plated bottom and sides of foot 244 is represented by lines 19*b*-19*b* and will be further explained in FIGS. 19B and 19G. An area of the bottom of the knit tube is knit in a reinforced manner and forms the plated bottom and sides of foot 244 when the toe seam 245 is stitched.

Figure 19B:
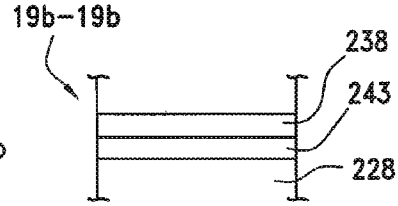
FIG. 19B is a cross section taken through section lines 19*b*-19*b* on FIG. 19A.

FIG. 19B is an enlarged detail of the plated inner thigh sections 19*b*-19*b* and plated bottom and sides of foot 19*b*-19*b*. An outer "bright" yarn or friction reducing yarn 238 is plated over an inner wicking yarn or fiber 243. The resulting knit fabric that makes up the plated knit inner thigh leg area 242 and the plated bottom and sides of foot 244. is worn against the person's 228 skin. The wicking yarn can be chemically treated to be antibacterial, antifungal or bacteriostatic.

Figure 19G:
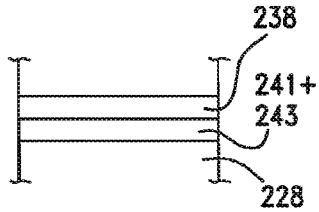
FIG. 19C are the knit tubes, cut in the torso area, with plated wicking inner thigh sections, and plated bottom and sides of feet.
FIG. 19D is the cut knit tubes, stitched together in the torso area, with plated wicking inner thigh sections, hemmed toes, and the unattached plated crotch gusset.
FIG. 19E is a cross section taken through section lines 19*e*-19*e* in FIG. 19D.
FIG. 19F is an alternate method of construction for the cross section taken through section lines 19*e*-19*e* on FIG. 19 D.
FIG. 19 G is an alternate method of construction for the cross section taken through section lines 19*b*-19*b* on FIG. 19A.

FIG. 19G is an alternative method of constructing the cross section taken through section lines 19*b*-19*b* in FIG. 19A. An antibacterial, antifungal or bacteriostatic yarn or fiber 241 is knit together with a wicking yarn or fiber 243 to form the inner layer and plated with an outer "bright" yarn or friction reducing yarn. The resulting knit fabric that makes up the plated knit inner thigh leg area 242 and the plated bottom and sides of foot 244 is worn against the person's 228 skin Should the manufacturer wish the wicking yarns or fibers can be chemically treated to be antibacterial, antifungal or bacteriostatic. In this case the antibacterial, antifungal or bacteriostatic yarn or fiber 241 can be omitted to reduce costs.

FIG. 19C is identical to FIG. 19A with the exception that the inner side of knit tube forming pantyhose garment with the cut edges of knit tubes, 256*a* the front, and 256*b* the back, respectively are shown.

FIG. 19D is a perspective view of the two leg panels that have been sewn together forming the torso center front and back seams, 227*a* and 227*b* respectively. The toes have been sewn forming the toe seam 245. All other parts are identical to those previously identified. The plated crotch gusset 236 is shown separately and has not been sewn in and a cross section represented by lines 19*e*-19*e* will be further explained in FIG. 19E. To finish the pantyhose garment 220, a hole is burned into the crotch 232 area of the garment 220, and then the plated crotch gusset 236 is stitched into the hole. To garment 220 may be "boarded" to obtain a pair of pantyhose in the shape of a person's 228 leg or not, and is at the discretion of the manufacturer.

FIG. 19E is an enlargement of a cross section taken through section lines 19*e*-19*e* in FIG. 19D. An outer antibacterial, antifungal or bacteriostatic yarn or fiber 241 is plated over an inner wicking yarn or fiber 243. The resulting knit fabric that makes up the platted crotch gusset 236 is worn against the person's 228 skin Should the manufacturer wish the wicking yarns or fibers can be chemically treated to be antibacterial, antifungal or bacteriostatic. In this case the outer antibacterial, antifungal or bacteriostatic yarn or fiber 241 can be omitted to reduce costs.

FIG. 19F is an alternative method of constructing the cross section taken through section lines 19*e*-19*e* in FIG. 19D. An antibacterial, antifungal or bacteriostatic yarn or fiber 241 is knit together with a wicking yarn or fiber 243 to form the inner layer and plated with an outer "bright" yarn or friction reducing yarn. The resulting knit fabric that makes up the platted crotch gusset 236 is worn against the person's 228 skin Should the manufacturer wish the wicking yarns or fibers can be chemically treated to be antibacterial, antifungal or bacteriostatic. In this case the antibacterial, antifungal or bacteriostatic yarn or fiber 241 can be omitted to reduce costs.

Description FIGS. 20A-20D

Figure 20A:
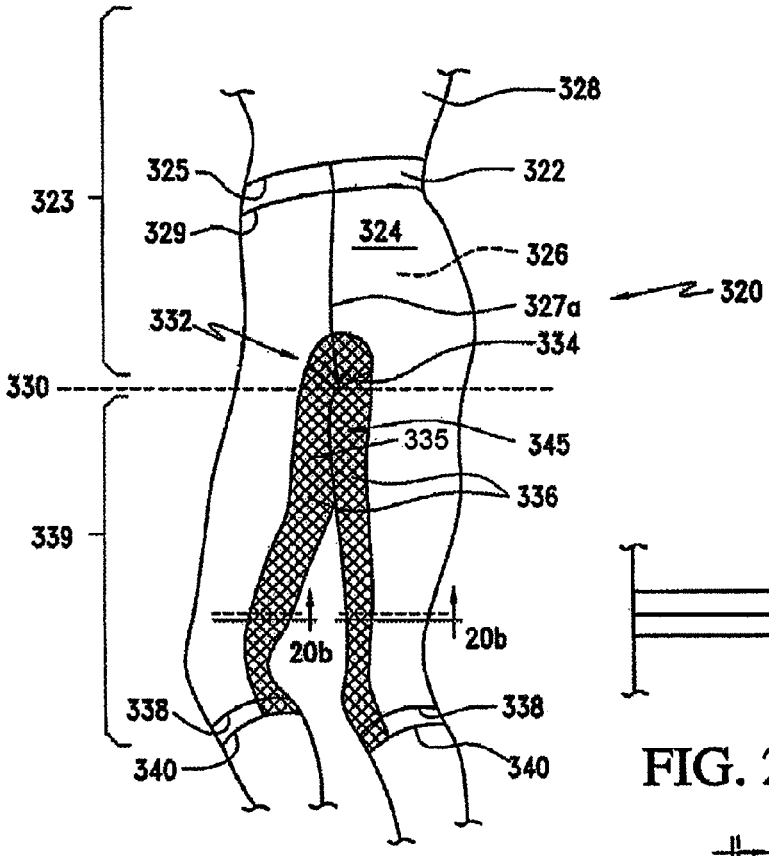
FIG. 20A is an above the knee circular knit garment with a plated inner thigh area.
Figure 20D:
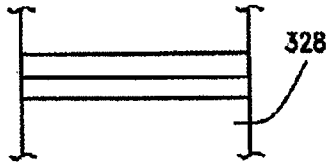
FIG. 20D is an alternative method of constructing the cross section taken through section lines 20*c*-20*c*.
Figure 20B:
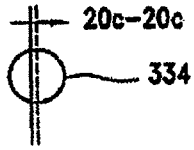
FIG. 20 B is a cross section through the plated inner thigh area.
FIG. 20C is a cross section through the plated crotch gusset.
Figure 20B:
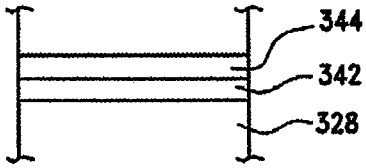
Figure 20C:
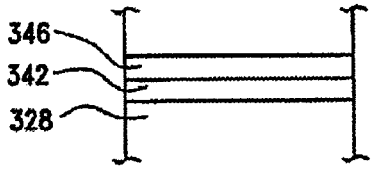
Figure 23:
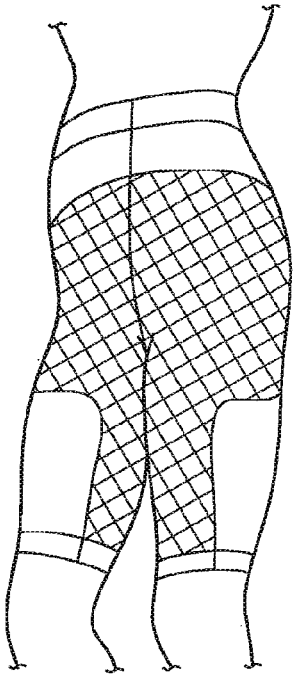
FIG. 23 is a plated knit above the knee garment.
Figure 24:
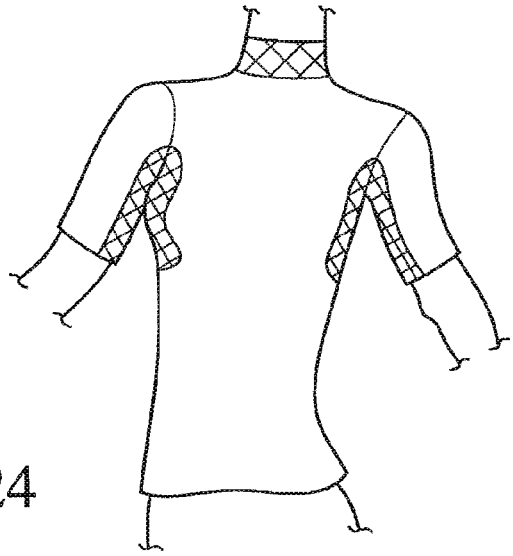
FIG. 24 is a garment with a plated underarm area.

Another embodiment of the present invention is incorporated and illustrated in FIGS. 20A-20D. In general, the present invention in FIGS. 20A and 20C is shown generally as a washable below the knee garment with plated inner thigh area or garment 320. It is an improvement over prior garments. A person 328 is wearing the garment 320 and comprises numbers 320 through 345. For purposes of clarity, like reference numerals are used where appropriate. The garment 320 is comprised of a torso portion 323 having a waistband 322, with a top of folded over waistband 325, a hem of folded over waistband 329, a front portion 324, and a back portion 326. Torso center front and back seams, 327*a* and 327*b* respectively, hold the two torso portions of the garment 320 together. Further, the garment 320 contains a pair of leg portions of the garment 339 that are connected at a perforated line 330 and extend downwardly. A plated crotch gusset 334, which will be further described, in FIG. 20C and FIG. 20D, covers a region of the angle formed by the junction of the legs or crotch 332. An inner part of the leg 340 is covered by a plated knit inner thigh leg area 335, and a plated crotch gusset 334. Plated inner thigh knit leg area 336 will be further described in FIG. 20A and FIG. 20B. A hem seam 338 and the bottom of folded edge of hem 340 finish the garment.

An important aspect of this invention is to provide the garment with the plated knit inner thigh area 336, a plated crotch gusset 334, and which is generally shown in FIGS. 20A, 20B. The garment 320 is constructed in the same way as the pantyhose garment 220, thus avoiding seams in the inner part of leg 345. The plated knit inner thigh leg area of garment 336 is knit into garment 320 so as to overlay the inner part of leg 345 of the person 328. The relative position of plated knit inner thigh leg area of garment 336 is to cover the inner part of leg 345 and is comprised of yarns that have stretch, wicking, antibacterial, antifungal and or antimicrobial, and friction reduction properties. This will be further described in FIG. 20B. The plated crotch gusset 334 is comprised of fibers that have wicking and antibacterial, antifungal or antimicrobial characteristics and will be further described in FIG. 20C.

FIG. 20B is an enlarged detail of the plated inner thigh sections 20*b*-20*b*. An outer "bright" yarn or friction reducing yarn 344 is plated over an inner wicking yarn or fiber 342. The resulting knit fabric that makes up the plated knit inner thigh leg area 336 is worn against the person's 328 skin. The wicking yarn can be chemically treated to be antibacterial, antifungal or bacteriostatic. Or, it can be knit with yarns or fibers that are antibacterial, antifungal or bacteriostatic together with the outer "bright" yarn or friction reducing yarn 344 so that the wicking/antibacterial, antifungal, bacteriostatic layer is against the skin 328 and the outer "bright yarn or friction reducing yarn 344 is on the outer surface of the garment.

FIG. 20C is an enlargement of a cross section taken through section lines 20*c*-20*c* of the plated crotch gusset 334. An outer antibacterial, antifungal or bacteriostatic yarn or fiber 346 is plated over an inner wicking yarn or fiber 342. The resulting knit fabric that makes up the platted crotch gusset 334 is worn against the person's 328 skin. Should the manufacturer wish the wicking yarns or fibers can be chemically treated to be antibacterial, antifungal or bacteriostatic. In this case the outer antibacterial, antifungal or bacteriostatic yarn or fiber 346 can be omitted to reduce costs. An outer "bright" yarn of friction reducing yarn 344 may or may not be used in place of the outer antimicrobial, antifungal or antibacterial yarns or fibers.

FIG. 20D is an alternative method of constructing the cross section taken through section lines 20*c*-20*c* in FIG. 20D. An antibacterial, antifungal or bacteriostatic yarn or fiber 241 is knit together with an inner wicking yarn or fiber 243 to form the inner layer and plated with an outer "bright" yarn or friction reducing yarn 238. The resulting knit fabric that makes up the platted crotch gusset 236 is worn against the person's 228 skin Should the manufacturer wish the wicking yarns or fibers can be chemically treated to be antibacterial, antifungal or bacteriostatic. In this case the antibacterial, antifungal or bacteriostatic yarn or fiber 241 can be omitted to reduce costs.

Description FIG. 21, FIG. 22, FIG. 23 and FIG. 24

FIG. 21, FIG. 22, FIG. 23 and FIG. 24 represent additional embodiments of garments that have wicking, antibacterial/antifungal/bacteriostatic and low friction properties. These garments have areas of inner wicking yarn 342 and outer "bright" yarn or friction reducing yarn 344 which are represented by the hatch marks. In these examples the inner friction yarn is treated with an antibacterial, antifungal or bacteriostatic chemicals. Antibacterial, antifungal or bacteriostatic fibers can also be incorporated with the inner wicking yarn 342 when plating the material.

The plating of these yarns in areas where there is moisture, heat and friction of skin rubbing against skin is very important in the reduction of Intertrigo for the wearer of the garments. Affected areas can include areas between and below the breasts. FIG. 21 is a plated brassiere, which may be plated in its entirety or in only affected areas, including between and/or below the breasts. As is conventional, the brassiere includes two breast supporting portions, which may optionally include a pair of cups; the breast supporting portions are connected by a fabric bridge; and a thorax-encircling band is united with the fabric bridge, and optionally one or more straps. Affected areas can also include below the abdomen, between the ribs and under the gut as in FIG. 22, below the gut, in the crotch, and between the thighs as in FIG. 23, and under the armholes and around the neck as in FIG. 24. All of these treated areas may be included singularly or in addition to other treated areas of a garment. All of these treated areas, represented by the hatch marks, can have the areas of inner wicking yam 342, antibacterial/antifungal/bacteriostatic yams 346, that are plated with an outer "bright" yarn or friction reducing yarn 344. The manufacturer is not limited to plating the designated areas exclusively. The garments may be plated in their entirety. The area with the hatch marks should consist of an inner wicking yarn 342 layer and an outer "bright" yam or friction reducing yarn 344. The antimicrobial, antifungal or antibacterial yarns or fibers can be knit with the inner wicking yarn 342 or the inner wicking yarn 342 can be chemically treated with antimicrobial, antifungal or antibacterial chemicals. The method to make these garments can either be "cut and sew", such that the plated portion is sewn-in to the garment, utilizing either wovens or knits, or knit, using circular or flat knitting techniques. The knits may be constructed with seams in a "cut and sew" fashion or knit in a circular method to produce a seamless circular knit tube from which "seamless" knit garments are formed.

It is understood that the invention is not limited to human apparel. The invention can also be used in pet apparel, and the like.

It is also understood that the invention is not restricted to the detailed description of the invention, which may be modified without departure from the accompanying claims.

SUMMARY, RAMIFICATIONS, AND SCOPE

From the description above, a number of advantages of my knit plated areas become evident:

(a) The portions of the panel from below the knee or above the knee to the crotch, i.e., the upper portion of the leg panels from above the knee to the crotch area, 36*b*, 136*b*, and the plated knit inner thigh leg area 242 eliminates the need for an inner thigh seam and thus irritation for the wearer, and consists of wicking fibers that have a plated outer friction reducing yarn or fiber, wick moisture away from a person's skin and reduce friction between a person's legs.

(b) The wicking. The combination of these yarns helps the skin stay dry, and help reduce the possibility of infections and concomitant odors. Or, the wicking yarns or fibers are plated with an antibacterial, antifungal, and bacteriostatic yarns or fibers on the inside of the garment and the friction reducing yarns or fibers are plated on the outside of the garment.

(c) Should the manufacturer wish, the antibacterial, antifungal, and bacteriostatic yarns or fibers can be eliminated in all of the areas previously described examples and the wicking fibers can be treated chemically with antibacterial, antifungal, and bacteriostatic chemicals to help eliminate odors and infections.

(d) Should the manufacturer wish the friction reducing yarns on the knit sewn in leg panel could be eliminated on one side to reduce costs. Friction reducing yarns are very expensive when compared to other yarn costs, sometimes ten times as much. The function of the friction reduction is not reduced for the wearer of the garment when one side is plated. Since friction reducing yarns typically retain heat it is preferable that they be eliminated on one side.

(e) The panels and gussets, whether knit sewn in leg panel 38, the "cut and sew" leg panel 138, and the plated crotch gusset 236 with the plated knit inner thigh panel 242, or any other type of panel with the previously described construction can be sewn or plated into any type of garment including ones not mentioned here with the sole purpose of reducing moisture, friction and bacteria or fungus or yeast for the wearer. It is up to the manufacturer to choose the type of garment to sew or plate the panels into.

(f) The panels or plated areas can be utilized by both genders and are not age specific. They can be utilized in the manufacture of any type of articles of apparel where wicking, friction reduction, and antibacterial, antifungal, and bacteriostatic properties are needed.

(g) The panel or plated areas' shapes can be tailored to accommodate the various types of garments manufactured and can be made larger or smaller as size determines as long as the affected areas are covered.

(h) The panels or plated areas can be used independently of a wicking and antimicrobial and bacteriostatic gusset should the manufacturer wish.

(i) All comparable parts of the garments are interchangeable, For example, the knit sewn in leg panel 38 can be utilized on a "cut and sew" garment and the "cut and sew" leg panel 138 can be utilized in a seamless garment should the manufacturer wish.

(j) The knit plated panels and areas in the legwear or hosiery can be used on any type of hosiery or legwear whether it is sheer, semi-opaque, opaque, non-control, control, a shaper, or any other type. It may also be utilized with any type of pattern such as lace, geometric, stripes, dots, or any other one the manufacturer wishes to utilize.

(k) The combination of the yarns helps the skin stay dry and without irritation from rubbing. Intertrigo is a red, moist irritation or friction in the following areas of a person; the groin and inner thigh area of people whose thighs rub together, between and under the breasts, between the ribs, under the gut, under the arm, in skin folds between the ribs and around the neck. The moist irritated skin can be infected with yeast, fungus and bacteria. The antibacterial, antifungal, and bacteriostatic yarns or chemical treatment of the fibers helps reduce infection. These types of embodiments of the wicking, friction reduction and antibacterial, antifungal, and bacteriostatic yarn or chemicals, reduce Intertrigo for the wearers.

(l) The garments contain panels or plated areas that are knit, thus providing superior fit over a woven garment with plated panels or areas. Knit conform more to the body and move with it when compared to a woven garment with plated areas or panels. Knitting is a very different process than weaving and is preferred for a garment that fits closely to the body that is curved.

(m) Two criteria for ensuring wicking are utilized that will ensure that the skin stays dry. The first method included yarns or fibers with a higher DPF, denier per filament, is plated on the inside of a fabric, and a yarn or fiber with a lower DPF, is plated on the outside of a surface of a fabric. The second method of using fibers or yarns with different shapes where there are fewer shapes on the yarns or fibers next to the skin in comparison to the number of shapes on the yarns or fibers on the outside surface of the material. Both methods insure that the surface of the wetted area on exterior surface of the garment is greater than the surface of the wetted area on the inside. The result is that a person's skin stays dry.

Although the description above contains many specificities, these should not be construed as limiting the scope of the invention but as merely providing illustrations of some of the presently preferred embodiments of this invention. For example, the gusset can have other shapes such as oval, trapezoidal, triangular, etc. The inner leg panels or plated areas can have other shapes, such as oval, trapezoidal, etc as long as the inner thigh area is covered.

The seams can be flat locked, French seamed; simulated French seamed, double-stitched, flat-felled, hairline, double-stitched, over edge-stitched, topstitched, double topstitched, lapped, tucked, etc. The style lines for the seam placement in the "cut and sew" garment's "cut and sew" sewn in leg panel can be placed either above the knee or below it in any area to the ankle and can be horizontal or oblique. All parts of the garment including the inner leg panels, crotch areas, and gussets may contain a stretch fiber for memory and shape retention. An illustrative example of the spandex type of yarn may take the form of DuPont's® Lycra® brand spandex or Bayer's® and Dorlastan®, each of which are made from elastic fibers. The spandex fiber can be covered, wrapped, with other fibers—natural or man-made—and is often used in this form in hosiery, narrow fabrics and wovens for ready-to-wear. The spandex can be covered in five ways: single-covered, double-covered, corespun, interlaced or air-covered and core-twisted as the manufacturer wishes. The knits can be warp knits, such as a Raschel knit, or a Tricot knit, and is ideal but not limited to bodywear and active sportswear. Circular knits, such as jersey knits, are ideal for bodywear, sportswear, and hosiery. In hosiery and ready to wear, where circular knitting machines are utilized such as a Santoni® machines, the spandex can also be "laid in" between rows of knitting, or knitted into every stitch, the latter producing superb fit and uniformity in the stitches.

The amount of spandex can range from as little as 1% to as much as 30% for shapewear. The bodies of the garments may be made of many materials whether man-made or natural or any and all blends of man-made fibers and synthetics. They include cotton, wool, silk, leather, linen, vinyl, Model, nylon-polyamides and polyamide co-polymers, LYCRA® spandex in different filament configurations, orlon, polyvinylidene fluoride, such as KNAR® polyester, for example, polyethylene terepthalate, glycol modified polyesters, such as PETG®, KODURA®, rayon, orlon cellulosic fiber blends, and the like, as well as blends of the above. The choice of materials to make the bodies of the garment out of is left to the discretion of the manufacturer. Closures may be zippers, Velcro®, buttons, snaps or any other type of closure the manufacturer wishes to utilize. The fly closure may be made in any design as the manufacturer wishes.

Thus the scope of the invention should be determined by the appended claims and their legal equivalents, rather than by the examples given.

The invention claimed is:

1. A brassiere comprising:

two breast supporting portions connected by a fabric bridge and a thorax encircling band united with said fabric bridge; and a knitted plated panel disposed below the breast supporting portions, said plated panel including a base portion, moisture transmitting fibers plated on an inside of said base portion and friction-reducing fibers plated on an outside of said base portion, wherein said plated panel causes perspiration from the wearer's skin to move to said moisture transmitting fibers and from said moisture transmitting fibers to said friction-reducing fibers, wherein said base portion is comprised of an elastic fiber, said friction-reducing fibers are nylon, and said moisture transmitting fibers are selected from the group consisting of cotton, polyester, viscose and wool; thereby providing a brassiere that reduces perspiration on the wearer's skin.

2. The brassiere of claim 1, wherein said brassiere comprises a seamless circular knit tube.

3. The brassiere of claim 1, wherein said plated panel is sewn into said brassiere.

4. The brassiere of claim 1, wherein said moisture transmitting fibers comprise at least one of antibacterial fibers, antifungal fibers, and bacteriostatic fibers.

5. The brassiere of claim 1, wherein said moisture transmitting fibers have a different denier per filament than said friction-reducing fibers.

6. The brassiere of claim 5, wherein said moisture transmitting fibers have a greater denier per filament than said friction-reducing fibers.

7. The brassiere of claim 1, wherein said elastic fiber is spandex.

8. The brassiere of claim 1, wherein said plated panel is further disposed in the breast supporting portions.

9. The brassiere of claim 1, wherein said plated panel is further disposed in the thorax-encircling band.

10. The brassiere of claim 1, wherein said plated panel is further disposed in the fabric bridge.

11. The brassiere of claim 4, wherein said moisture transmitting fibers are antibacterial fibers.

12. The brassiere of claim 4, wherein said moisture transmitting fibers are antifungal fibers.

13. The brassiere of claim 4, wherein said moisture transmitting fibers are bacteriostatic fibers.

14. The brassiere of claim 1, wherein said moisture transmitting fibers are chemically treated to be antibacterial.

15. The brassiere of claim 1, wherein said moisture transmitting fibers are chemically treated to be antifungal.

16. The brassiere of claim 1, wherein said moisture transmitting fibers are chemically treated to be bacteriostatic.

17. The brassiere of claim 1, wherein said moisture transmitting fibers comprise fibers which are chemically treated to be at least one of antibacterial, antifungal, and bacteriostatic.

18. The brassiere of claim 1, further comprising at least one strap.

19. The brassiere of claim 18, wherein said plated panel is further disposed in said at least one strap.

20. The brassiere of claim 1, further comprising a pair of straps.

21. The brassiere of claim 20, wherein said plated panel is further disposed in both of said straps.

22. The brassiere of claim 1, wherein at least one of said moisture transmitting fibers, said friction-reducing fibers, and said elastic fiber is yarn.

* * * * *